US005682190A

United States Patent [19]

Hirosawa et al.

[11] Patent Number: 5,682,190

[45] Date of Patent: Oct. 28, 1997

[54] INK JET HEAD AND APPARATUS HAVING AN AIR CHAMBER FOR IMPROVING PERFORMANCE

[75] Inventors: Toshiaki Hirosawa, Hiratsuka; Yutaka Koizumi, Yokohama; Jiro Moriyama, Kawasaki; Mineo Kaneko; Torachika Osada, both of Yokohama; Hidemi Kubota, Komae, all of Japan

[73] Assignee: Canon Kabushiki Kaisha, Tokyo, Japan

[21] Appl. No.: 138,032

[22] Filed: Oct. 19, 1993

[30] Foreign Application Priority Data

| | | | |
|---|---|---|---|
| Oct. 20, 1992 | [JP] | Japan | 4-281461 |
| Apr. 16, 1993 | [JP] | Japan | 5-089973 |

[51] Int. Cl.[6] ..... B41J 2/05

[52] U.S. Cl. ..... 347/94; 347/42

[58] Field of Search ..... 347/20, 21, 40, 347/42, 54, 65, 67, 84, 85, 92, 94

[56] References Cited

U.S. PATENT DOCUMENTS

| | | | |
|---|---|---|---|
| 4,403,228 | 9/1983 | Miura et al. | 347/21 |
| 4,539,569 | 9/1985 | Watanabe et al. | 347/43 |
| 4,578,687 | 3/1986 | Cloutier et al. | 347/94 |
| 4,611,219 | 9/1986 | Sugitani et al. | 347/40 |
| 4,894,667 | 1/1990 | Moriyama | 347/68 |
| 4,929,968 | 5/1990 | Ishikawa | 347/21 |
| 4,947,191 | 8/1990 | Nozawa et al. | 347/30 |
| 5,006,867 | 4/1991 | Koizumi et al. | 347/17 |
| 5,023,630 | 6/1991 | Moriyama | 347/68 |
| 5,175,567 | 12/1992 | Asai | 347/56 X |
| 5,220,345 | 6/1993 | Hirosawa | 347/85 |

FOREIGN PATENT DOCUMENTS

| | | | |
|---|---|---|---|
| 0306341 | 3/1989 | European Pat. Off. . | |
| 0376922 | 7/1990 | European Pat. Off. . | |
| 59-98859 | 6/1984 | Japan | 347/94 |
| 61-154947 | 7/1986 | Japan | B41J 3/04 |
| 1-308644 | 12/1989 | Japan | B41J 3/04 |

*Primary Examiner*—Joseph W. Hartary

*Attorney, Agent, or Firm*—Fitzpatrick, Cella, Harper & Scinto

[57] ABSTRACT

An ink jet head comprises a plurality of ink liquid paths in which energy generating elements are formed, a common liquid chamber communicated with the plurality of ink liquid paths, and an air chamber which is communicated with the common liquid chamber via a communication section formed at substantially a central portion of the air chamber and which Is formed along the longitudinal direction of the common liquid chamber. This arrangement of the ink jet head enables air in the air chamber to act on refilling behavior of ink in each of the ink liquid paths so that refilling in each of the ink liquid paths is not delayed.

11 Claims, 31 Drawing Sheets

INK JET HEAD AND APPARATUS HAVING AN AIR CHAMBER FOR IMPROVING PERFORMANCE

BACKGROUND OF THE INVENTION

1. Field of the Invention

The present invention relates generally to an ink jet head for performing a printing operation by ejecting ink to a recording medium, a method of producing an ink jet head of the foregoing type, and an ink jet apparatus operable using an ink jet head of the foregoing type. More particularly, the present invention relates to improvement of an ink jet head, a method of producing an ink jet head of the foregoing type and an ink jet apparatus operable using an ink jet head of the foregoing type wherein the ink jet head includes a chamber (serving as a buffer chamber) containing a gas for suppressing ink vibration induced as the ink, i.e., a recording liquid is ejected from a number of ink ejecting outlets.

2. Description of the Related Art

An ink jet system has been hitherto practiced such that a recording liquid such as ink or the like (hereinafter referred to simply as ink) is ejected from a plurality of fine liquid ejecting outlets (hereinafter referred to as ink ejection outlets or simply as outlets) in the form of ink droplets so that recording (which includes so-called printing) is achieved on a recording material such as paper, plastic sheet, cloth or the like with the liquid droplets shot thereon corresponding to recorded information or figure information. The ink jet system offers advantages such that recording can be achieved at a high speed and a plain paper or a similar material can be used for a recording medium without any problem.

An ink jet apparatus used for practicing the ink jet system is equipped with an ink jet head which includes a number of ink ejection outlets, an ink path communicated with the respective ink ejection outlets, and a plurality of energy generating elements in the liquid path such as piezoelectric elements, heat generating resistors or the like for generating the energy required for ink ejection in the liquid path. When a recording operation is performed, ejection energy is first generated from the energy generating elements, the generated heat is then applied to ink in the liquid path to generate the pressure required for ink ejection, and subsequently, ink is ejected from the ink ejection outlet so as to allow ink droplets to be shot onto the recording material.

Solvent components such as water, aqueous organic solvent, non-aqueous organic solvent or the like having a recording agent component such as pigment, dye or the like dissolved or dispersed therein have been usually used as ink to be used for ink jet recording.

The pressure required for ink ejection of the ink jet head is generated by applying the thermal energy generated by the energy generating elements to ink in the liquid path so that a part of the pressure is distributively transmitted in the direction toward the ink ejection outlet via the ink in the liquid path, while other part of the same is transmitted in the direction toward a liquid chamber, i.e., in the opposite direction to the ink ejection outlets. As the pressure transmitted to the ink ejection outlets is applied to ink, the ink is squeezed out of the ink ejection outlet so as to allow it to be ejected therefrom. When the ejected ink is parted away from the ink ejection outlet in the form of ink droplets, the meniscus formed in a liquid path in the vicinity of the ink ejection outlet is retracted depending on a quantity of ejected ink, but after a certain time elapses, the ink filled state having the liquid path filled with ink is restored to the original state before ink ejection due to surface tension which is effective for drawing the meniscus toward the ink ejecting outlet. This phenomenon is called refill. When recording is practically effected, the aforementioned actions are repeated, and stable ink ejection can continuously be achieved as long as good refill occurs.

If ink ejection is continuously effected while refill occurs incorrectly, this means that ink ejection is continuously effected while the meniscus is incompletely returned to the proper ejection position after completion of the ink ejection. As a result, a quantity of ejected ink is reduced. For example, a diameter of each ink dot formed on a recording material by ink droplets is reduced due to the shortage of the quantity of ejected ink. Thus, recording can not be achieved with a predetermined quantity of ink, resulting in the quality of the recorded image being extremely degraded. In addition, such a phenomenon as mentioned above leads to the result that a shooting accuracy of ejected ink droplets onto the recording material is degraded, causing malfunctions such as vague appearance of a recorded image, warpage of the recorded image, appearance of a stripe on the recorded image and formation of white spots on the recorded image to readily arise.

To solve the problems associated with the conventional liquid recording technology like the aforementioned ink jet system, the structure of liquid paths and associated components were improved and physical properties of ink were correctively adjusted. In the case of an ink jet head including number of ink ejection outlets, however, satisfactory improvable effects could not often be obtained merely by the improvement and corrective adjustment as mentioned above.

With a conventional ink jet head 100 including a number of ink ejection outlets 101, a number of liquid paths 102, a number of energy generating elements 103 and a common liquid chamber 104 as shown in FIG. 29A, when ink is ejected from the ink ejecting outlets 101 at the same time or with just a small time difference therebetween, the pressure is applied to ink in each liquid path 102 in the direction toward the common liquid chamber 104 in such a manner as mentioned above, and the pressures arising in the respective liquid paths 102 are integrated with each other in the common liquid chamber 104 to generate a large magnitude of pressure therein. The pressure arising in each liquid path 102 acts on ink as a squeezing power so as to allow the ink to be squeezed in the direction toward the common liquid chamber 104, i.e., in the direction of arrow A, and a total of the pressures arising in the respective liquid paths 102 is enlarged several times compared with an ink jet head including a single ink ejection outlet. Thus, as shown in FIG. 29B, to assure that a good refill state is maintained, it is necessary that a large quantity of ink is quickly displaced in the direction toward the ink ejection outlets 101, i.e., in the direction of arrow B, and moreover, to shift the displacement of ink in the direction of arrow A to the displacement of ink in the direction of arrow B, a high intensity of pressure enough to stand against the aforementioned initial large inertia power (total pressure) is required.

However, the surface tension appearing on a meniscus 106 in the vicinity of the ink ejection outlet 101 to serve as a motive power for inducing a refill state in each liquid path 102 does not satisfactorily act so as to instantaneously displace a large quantity of ink in the direction toward the ink ejection outlets 101 against the aforementioned total pressure in the direction toward the common liquid chamber 104. In other words, as the initial inertia power induced by the displacement of ink is enlarged, a longer time is required until each meniscus 106 is returned. When a sufficiently long time is taken until each meniscus 106 is returned, there arises a malfunction in that the recording speed is reduced. On the contrary, in the case that a sufficiently long time can not be taken until each meniscus 106 is returned, there arise malfunctions in that a predetermined quantity of ink can not be ejected from each ink ejection outlet 101 and acceptable recording can not be achieved.

A mechanism for appearance of the aforementioned phenomenon will briefly be described below with reference to FIG. 30A which shows a curve of rearward displacement of each meniscus.

A quantity of rearward displacement L (μm) of a meniscus shown on an ordinate in FIG. 30A represents a length L in a liquid path 102 on the ink ejection outlet 101 side as shown in FIG. 30B. Specifically, the length L is equal to a distance as measured from an ink ejection outlet 101 to the rearmost end of an ink meniscus 106. In the case of an ink jet head including a single ink ejection outlet, as shown by a curve $C_{M1}$ in FIG. 30A, at the time $t_0'$ that a certain time elapses from the time $t_0$ when the thermal energy generated by the energy generating element 103 is applied to ink in the liquid path 102, i.e., at the time when ink ejection is effected, a meniscus 106 is positioned in the vicinity of the ink ejection outlet 101, and it is then quickly displaced in the rearward direction. Thereafter, a quantity of rearward displacement of the meniscus 106 is maximized at a time $t_1'$, and subsequently, the meniscus 106 starts to gradually return to the original position by the function of the restoring power induced by the surface tension. Finally, refill is completed at the time $t_1$.

On the contrary, in the case of an ink jet head including number of ink ejection outlets, as illustrated by a curve $C_{M2}$, a quantity of rearward displacement of the meniscus 106 is maximized at the same time as the time $t_1'$ or at the time $t_2'$ slightly later than the time $t_1'$. However, a maximum value of quantity of rearward displacement of the meniscus 106 is small, and a refill speed of the meniscus 106 is slow as represented by $t_2$. It is considered that this is because a total value of the pressures effective for squeezing ink from the liquid paths 102 in the rearward direction largely exceeds the pressure effective for flowing ink in the common liquid chamber 104, and the pressure which has failed to flow ink is left as it is but the foregoing pressure serves so as to allow a refill speed for returning the meniscus 106 to become extremely slow.

The aforementioned phenomenon scarely appears after ink ejection is continuously repeated, since ink steadily flows from an ink feed tube 105 (referring to FIGS. 29A and 29B) to the common liquid chamber 104. However, it remarkably appears at the initial time of ink ejection, especially until the ink flow becomes steady.

When the frequency of applying a recording signal to the energy generating element 103 is set to be longer than the time between the time $t_0$ and the time $t_2$ shown in FIG. 30A, no particular problems arise with the reduction of the refill speed of the ink jet head including number of ink ejection outlets 101. However, in the case that a recording signal is applied to the energy generating unit 103 at the frequency shorter the time between the time $t_0$ and the time $t_2$, when a next recording signal is applied to the energy generating element 103 while refill is not completed, e.g., a quantity of rearward displacement of the meniscus 106 is 30 μm or more, a quantity of ejected ink droplets is reduced, preventing good recording from being achieved.

To solve the foregoing problem, a structure including atmosphere opening portions each located in the vicinity of a liquid path communicated with a common liquid chamber so as to absorb in the foregoing opening portion the pressure effective in the direction toward the common liquid chamber at the time of ink ejection is disclosed in an official gazette of U.S. Pat. No. 4,578,687. With this structure disclosed in the prior art, however, since the common liquid chamber is exposed to an atmosphere, a solvent containing contained in the ink is vaporized to the outside via the atmosphere opening portions. Thus, there arise problems that a viscosity of ink in the ink jet head is increased, and moreover, the liquid path and the ink ejecting outlets are clogged with precipitated solid substances contained in ink, causing incorrect printing to be readily effected. In addition, another problem is that a gas bubble grows in the common liquid chamber due to the influence of vibration or the like, resulting in special designing becoming necessary for the purpose of preventing a foreign matter such as dust or the like from entering the ink jet head. For this reason, the above-proposed structure does not exhibit any sufficient practicability.

In view of the foregoing problems, an assignee common to the present invention proposed a ink jet head including a pressure-volume converting unit capable of reversibly converting the pressure associated with refill into variation of a volume as disclosed in an official gazette of Japanese Patent Application Laying-Open No. 308644/1989. Specifically, according to the prior art, the ink jet head includes means for keeping gas bubbles in a liquid chamber.

In practice, the ink jet head proposed by the assignee contributes to the elimination of the aforementioned problems. However, to assure that the ink jet head is constructed in such a manner as to include a pressure-volume converting unit in the liquid chamber or adjacent to the liquid chamber, new components and a new process are additionally required. This leads to the result that the ink jet head is produced at the correspondingly increased cost.

With the ink jet head constructed as disclosed according to the prior art, as shown in FIG. 31, buffer chambers 7, 7 having gas bubbles 72, 72 grown therein are disposed sidewards of the array of energy generating elements. In the case of an ink jet head as described above, when it includes a small number of energy generating elements, liquid vibration can be absorbed satisfactorily in the buffer chamber 7. However, when the ink jet head includes a large number of energy generating elements, e.g., several thousand energy generating elements, the liquid vibration can not always be absorbed satisfactorily in the buffer chamber 7. When the buffer chamber 7 contains large size of gas bubble so as to assure a sufficient buffer effect, it is unavoidably designed with large dimensions. Thus, in the case that the buffer chambers 7, 7 are disposed sidewards of the array of the energy generating elements, the ink jet head is undesirably enlarged.

To produce an ink jet head of the foregoing type, there has been known a method wherein a plate of glass or metallic material is used as a material for a base board, a groove is formed on the plate by employing a cutting process, an etching process or the like, and thereafter, another base board having a piezoelectric element for generating energy for the purpose of ink ejection and a driving element such as an electrothermal converting element or the like attached thereto is connected to the first-mentioned base board so as to form a fine ink ejecting outlet, an ink flow path or the like.

However, when the foregoing method is practically employed for producing an ink jet head, it is difficult to prepare an air chamber large enough to correspond to an ink jet apparatus. In addition, it is difficult to produce easily the whole ink jet apparatus at a high yielding rate while maintaining a high dimensional accuracy. Especially, with the ink jet apparatus produced by employing the aforementioned conventional method, ink ejecting characteristics readily fluctuate due to coarse surface roughness on a flow path. In addition, when the cutting process is employed, breakage or cracking readily occurs on the material to be worked. Consequently, the ink jet apparatus is produced at a low yielding rate. On the other hand, when the etching process is employed, the ink jet head is produced at an increased cost due to many production steps required for production thereof. Another problem is that when two base boards, i.e., a first base board and a second base board are connected to each other, it is difficult to have the first base board correctly aligned with the second base board, and so the ink jet head is mass produced only with much difficulty. To eliminate the aforementioned problems inherent to the conventional method, the assignee invented a method of producing a liquid jet head wherein an active energy ray setting material is used as a material for forming a liquid path therein, and filed an application for patent under Japanese Patent Application Laying-Open No. 154947/1986. However, it has been found that this method is not always satisfactory in respect of a size and a height to be determined for each of a common liquid chamber communicated with an ink liquid path, an air chamber and associated components. Especially in the case of the so-called full line liquid jet apparatus including number of ink ejection outlets arranged at a high density across the whole width of a recording material such as a paper or the like so as to simultaneously eject ink from the ink ejection outlets, there arises a significant problem in that it is difficult from the viewpoint of economical production of the liquid jet apparatus to additionally form an air chamber in a liquid jet head.

SUMMARY OF THE INVENTION

An object of the present invention is to provide an ink jet head and an ink jet apparatus which assure that a capability of ink refilling can substantially be improved without any occurrence of a malfunction where ink is incorrectly ejected especially at the beginning time of a recording operation, and moreover, they can be produced at an inexpensive cost with high speed responsiveness and excellent ink ejection stability.

Another object of the present invention is to provide a method of producing an ink jet head at an inexpensive cost on the basis of mass production wherein there rarely arise a malfunction where ink is incorrectly ejected from the ink jet head after the ink ejection outlets are not used for a long time, and moreover, high speed recording can be achieved at a high driving frequency.

In the first aspect of the present invention, an ink jet head includes a plurality of ink liquid paths arranged in the side-by-side relationship, each of the ink liquid paths including an energy generating element for generating energy required for ink ejection, and a common liquid chamber arranged in substantially parallel with a direction of arrangement of the plurality of ink liquid paths for feeding ink to the ink liquid paths, so as to eject ink from a plurality of ink ejection outlets by driving the energy generating elements, the ink jet head comprises;

an air chamber extending along an arrangement of the plurality of ink liquid paths and communicated with the common liquid chamber via a communication section located at the substantially central part thereof, the air chamber containing gas therein for absorbing pressure fluctuation propagating in the ink received in the common liquid chamber.

Here, the air chamber may be divided into plural segments.

The communication section may include a plurality of communication path walls.

A volume of the common liquid chamber may be larger than that of the air chamber.

A cross-sectional area of each of the ink liquid paths may be equal to or larger than that of each of a plurality of communication paths defining the communication section.

A total of the sectional areas of the communication paths defining the communication section may be equal to twice or more of value obtained by converting a total quantity of ink simultaneously ejected from all the ink ejection outlets into an area.

A total of the sectional areas of the communication paths defining the communication section may be equal to 1/10 or more of the total cross-sectional area of the ink flow paths.

The ink ejection outlets may be arranged in the form of a full-line head having a width corresponding to a width of a recording medium.

Each of the energy generating elements may be a heat generating resistor element.

In the second aspect of the present invention, an ink jet apparatus for performing a recording operation by ejecting ink includes:

an ink jet head including a plurality of ink liquid paths arranged in the side-by-side relationship, each of the ink liquid paths including an energy generating element for generating energy required for ink ejection, and a common liquid chamber arranged in substantially parallel with a direction of arrangement of the plurality of ink liquid paths for feeding ink to the ink liquid paths, so as to eject ink from a plurality of ink ejection outlets by driving the energy generating elements. The ink jet head also includes:

an air chamber extending along an arrangement of the plurality of ink liquid paths and communicated with the common liquid chamber via a communication section located at the substantially central part thereof, the air chamber containing gas therein for absorbing pressure fluctuation propagating in the ink received in the common liquid chamber, or the ink jet head where the air chamber is divided into plural segments, and conveying means for conveying a recording medium.

In the third aspect of the present invention, a method of producing an ink jet head including a plurality of ink ejecting outlets for ejection ink therefrom, a plurality of ink liquid paths communicated with the ink ejection outlets, a plurality of energy generating elements arranged corresponding to the ink liquid paths, a common liquid chamber for feeding ink to the ink liquid paths, and an air chamber communicated with the common liquid chamber via a communication section, via the steps of;

providing a first base board having the plurality of energy generating elements arranged thereon in the side-by-side relationship, forming on the first base board, a mold member for forming the plurality of ink liquid paths, the common liquid chamber for feeding ink to the ink liquid paths, and the communication section;

disposing a filling member in such a manner as to cover the mold member therewith, disposing a second base board having a groove formed thereon to constitute the common liquid chamber and the air chamber, and removing the mold member.

Here, the filling member may be a photosensitive resin, further comprising the step of conducting exposure treatment for removing a part of the filling member corresponding to the groove on the second base board, and moreover, removing a part of the mold member corresponding to the groove after the step of disposing the second base board.

A plurality of the communication sections may be formed using the mold member, and a plurality of the air chambers are formed by sealably closing each air chamber between adjacent communication sections.

The above and other objects, effects, features and advantages of the present invention will become more apparent from the following description of the embodiment thereof taken in conjunction with the accompanying drawings.

DESCRIPTION OF THE PREFERRED EMBODIMENTS

The present invention will now be described in detail hereinafter with reference to the accompanying drawings which illustrate preferred embodiments thereof.

Figure 1:
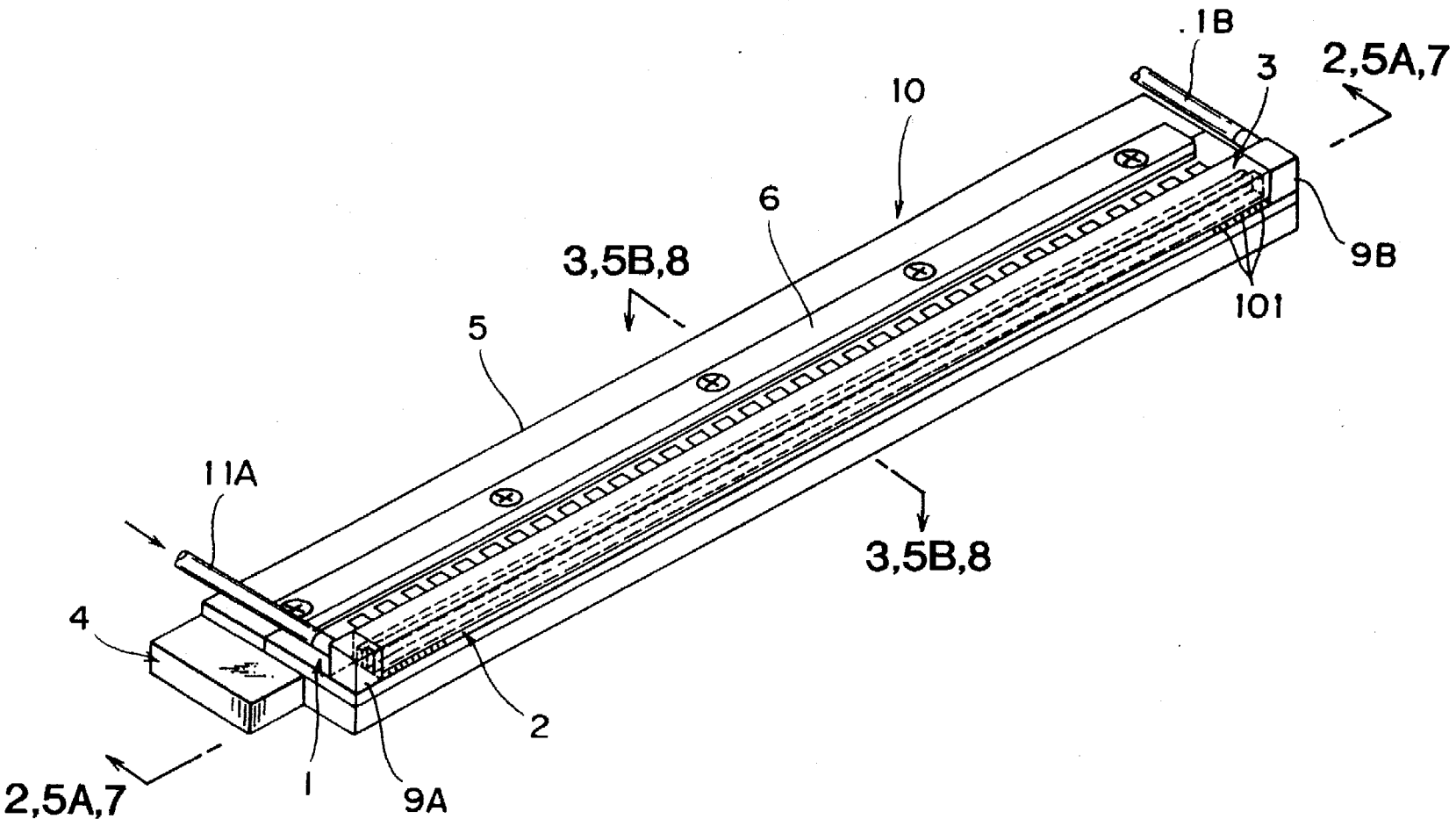
FIG. 1 is a perspective view which shows the fundamental structure of an ink jet head constructed according to the present invention.
Figure 2:
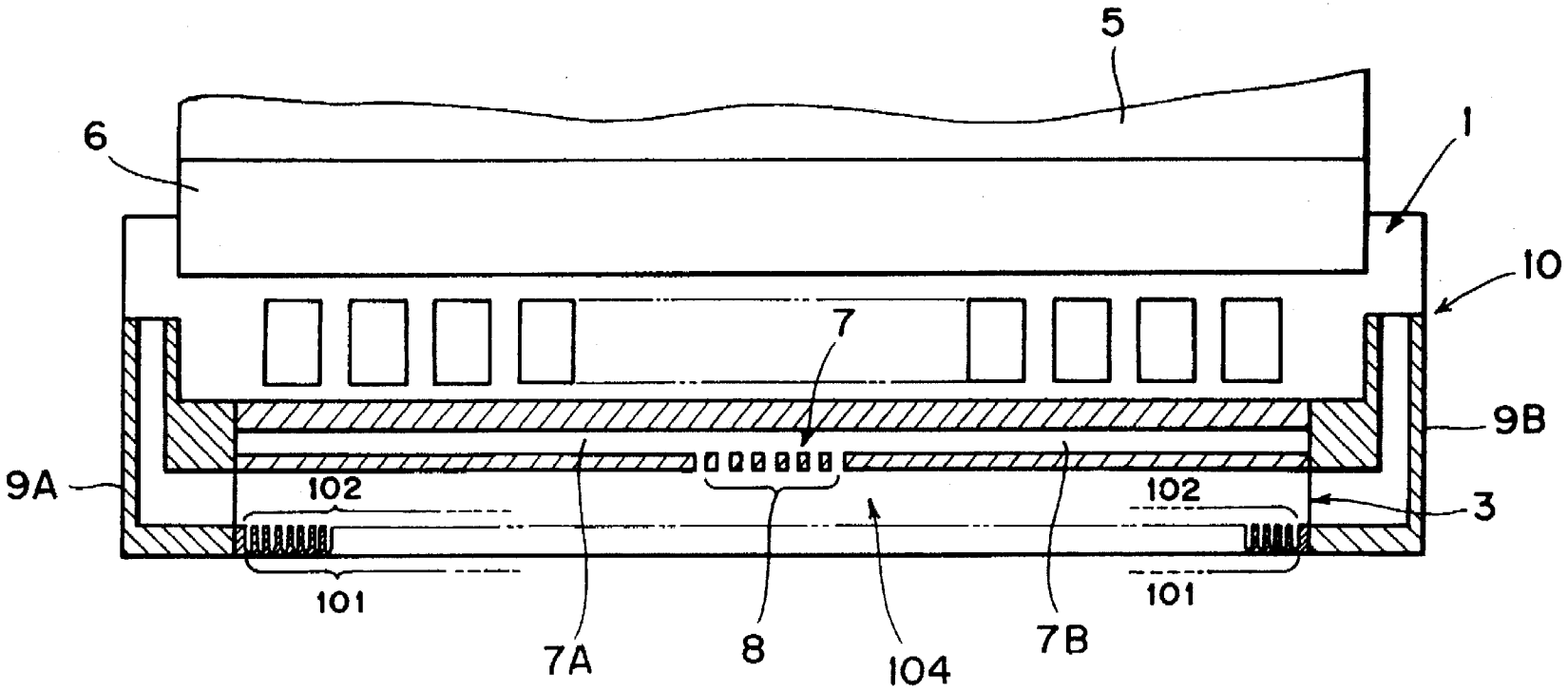
FIG. 2 is a fragmentary sectional plan view of the ink jet head of the present invention taken along a line 2/5A/7—2/5A/7 in FIG. 1.
Figure 3:
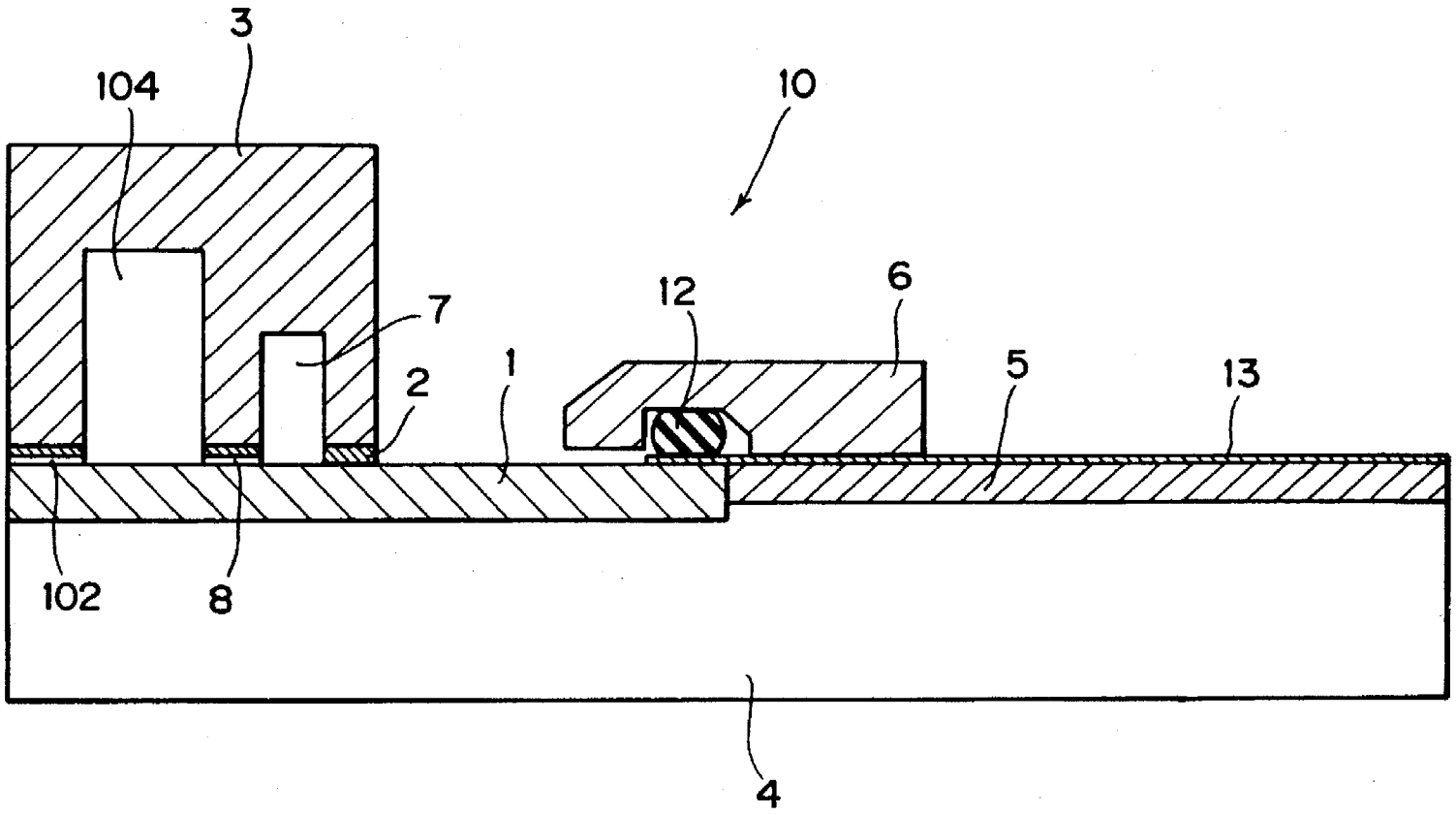
FIG. 3 is an enlarged vertical sectional view of the ink jet head of the present invention taken along a line 3/5B/8—3/5B/8 in FIG. 1.

FIG. 1 is a perspective view of an ink jet recording head constructed according to a first embodiment of the present invention, FIG. 2 is a sectional view of the recording head shown in FIG. 1, and FIG. 3 is an enlarged vertical sectional view of the recording head taken along a line 3/5B/8—3/5B/8 in FIG. 1. In these drawings, reference numeral 1 designates a first base board (heater board) made of a silicon substrate and having a plurality of energy generators (not shown), e.g., electrothermal converting elements (hereinafter referred to as ejection heaters) and number of wiring conductors each made of aluminum or the like for feeding electricity to the ejection heaters formed thereon by employing a film forming technique, reference numeral 2 designates an ejection portion forming member (solid layer) having number of ink ejection outlets 101 for ejecting ink therefrom and number of liquid paths 102 communicated with the ejection outlets 101 formed therein, respectively, and reference numeral 3 designates a second base board for structuring a common liquid chamber 104 being communicated with the liquid paths 102 formed therein and having ink to be fed to the liquid paths 102 stored therein. The solid layer for constructing the liquid paths 102 and being formed corresponding to the ejection heaters is laminated on the first base board 1, and a second base board 3 is laminated on the solid layer. The first base board 1 is positionally fixed on a base plate 4, and a flexible base board 5 for feeding electrical signals therethrough for the purpose of ejecting ink is exactly located relative to an electrical pad placed on the first base board 1. In addition, the base board 5 is firmly fixed to the base plate 4 in the compressed state by securing a flexible retainer 6 by tightening a bolt (not shown).

In this embodiment, as shown in FIG. 2 and FIG. 3, a recording head 10 includes an air chamber (serving as a buffer chamber) in the second base board 3 located outside of a liquid chamber 104, and the liquid chamber 104 and the air chamber 7 are preformed in the form of two longitudinally extending parallel grooves by employing a cutting process or an injection-molding process before the second base board 3 is laminated on the solid layer 2.

When the liquid paths 102 are formed across the solid layer 2, a communication portion 8 is formed between the liquid chamber 104 and the air chamber 7 at substantially the center of the liquid paths 102 as seen in the longitudinal direction so as to establish communication therebetween. Ink feed tubes 11A and 11B (referring to FIG. 1) are connected to the opposite ends of the liquid chamber 104 via ink feed joints 9A and 9B, while the rear ends of the ink feed tubes 11A and 11B are connected to an ink tank (not shown). Incidentally, the opposite ends of the air chamber 7 are sealably closed with an adhesive or a similar material.

Next, a behavior of ink during a recording operation to be performed by ink ejection will be described below with reference to FIGS. 4A and 4B.

With the ink jet head 10 constructed in the above-described manner, first, ink is fed to the ink liquid chamber 104 from the ink tank via the ink feed tubes 11A and 11B. While the liquid chamber 104 and the liquid paths 102 are filled with ink, in response to a recording electrical signal fed to the ejection heaters 103, thermal energy is generated by the ejection heaters 103, causing the ink in the liquid paths 102 to be heated, whereby ink droplets are ejected from number of ejection outlets 101 in conformity with the aforementioned pressure transmission mechanism to achieve a recording operation.

Figure 4A:
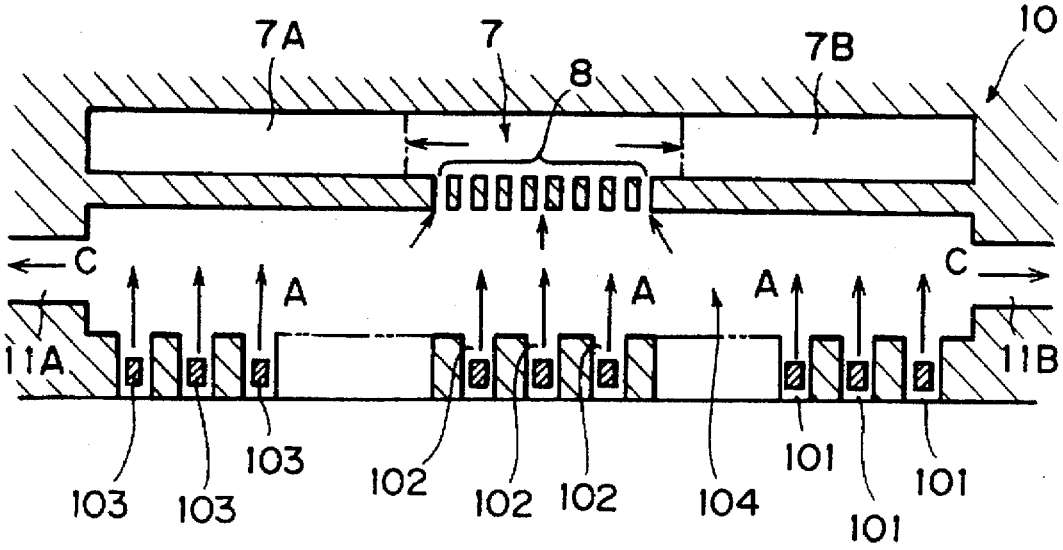
FIGS. 4A and 4B are fragmentary sectional plan views of the ink jet head of the present invention, particularly showing a behavior of ink at the time of ink ejection.
Figure 4B:
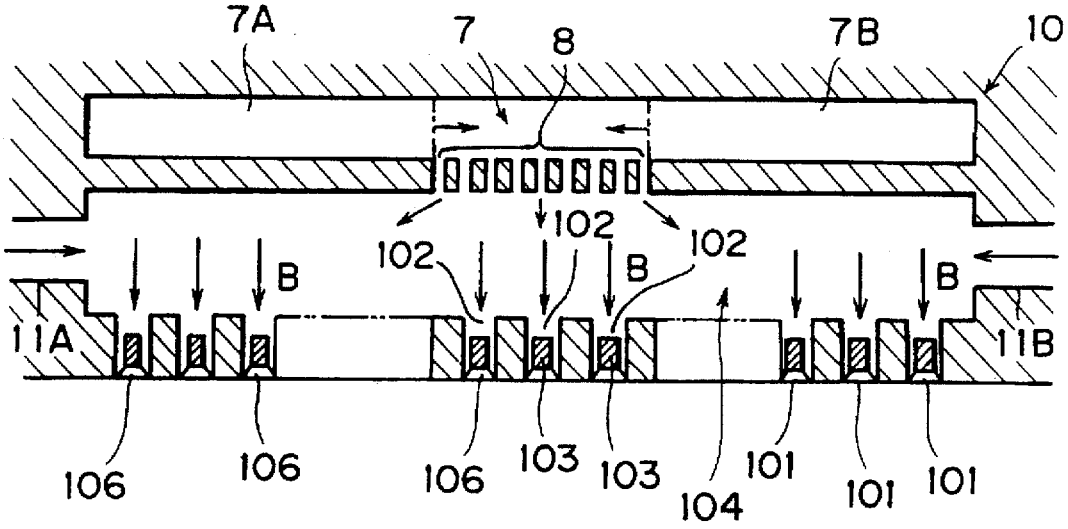

As shown in FIG. 4A, a low intensity of squeezing power for squeezing ink toward the ink liquid path 104 from the respective liquid paths 102 in the direction of arrow A appears every time ink ejection is completed. However, since the ink liquid chamber 104 is communicated with the air chamber 7, the foregoing pressure derived from the respective liquid paths 102 is absorbed in two regions 7A and 7B of the air chamber 7. Consequently, the generation of the power effective for returning ink from the ink liquid chamber 104 to the ink feed tubes 11A and 11B in the direction of arrow C is suppressed or prevented. Subsequently, as shown in FIG. 4B, in the circumstances as mentioned above, the surface tension of ink appearing over each meniscus 106 formed by ink ejection is transformed into the power for displacing ink in the direction of extension of each liquid path 102, resulting in ink refilling being started. At this time, the restoring power of the air in both the regions 7A and 7B of the air chamber 7 is applied to the liquid chamber 104 so that it functions in the direction of arrow B so as to compensate the power for displacing ink in the direction toward ink ejection outlets during the ink refilling operation.

In the case that the ink jet head 10 does not include any air chamber such as the air chamber 7 or the like, the power effective for squeezing ink from the liquid paths 102 in the direction toward the liquid chamber 104 acts on the refilling power in the opposite direction. In contrast with the foregoing case, in this embodiment, the power effective for squeezing ink from the liquid paths 102 in the direction toward the liquid chamber 104 is absorbed in both the regions 7A and 7B of the air chamber 7. In other words, this power effectively functions in such a manner as to compensate for the power for achieving ink refilling. Accordingly, ink refilling can smoothly be achieved for a short time. This makes it possible that the ink jet head 10 can respond to the high driving frequency, and moreover, an excellent quality image can be recorded at a high speed.

In addition, in this embodiment, since the air chamber 7 is arranged substantially in parallel with the liquid chamber 104 common to a row of the energy generating elements and with the direction of the array of the ink liquid paths, gas sufficient to assure a buffer effect can be reserved in the ink jet head 10 without any necessity for enlarging the ink jet head 10 itself. Furthermore, this arrangement enables the air chamber to be long and slender so that the power of air in the air chamber is very effective to compensate for the power for achieving ink refilling.

The communication portion 8 can formed at the same time when number of liquid paths 102 are formed through the solid layer 2. A method of forming the communication portion 8 and the liquid paths 102 will be described in detail later. Here, it is assumed that a communication portion to be described hereinafter represents the whole communication forming region inclusive of a plurality of walls defined between adjacent communication paths (hereinafter referred to as communication path forming walls) in the case that a plurality of communication paths are concentratively formed in a single region.

Next, an ink jet head constructed according to a second embodiment of the present invention will be described below with reference to FIG. 5. In contrast to the first embodiment of the present invention, in this embodiment, the length of an air chamber as seen in the longitudinal direction of the head is substantially equally divided into plural air chamber segments, i.e., air chamber segments 71, 72 and 73. Reference numerals 12A and 12B designate partition walls for the air chamber segments 71, 72 and 73. With this construction, the three air chambers 71, 72 and 73 are communicated with common ink chamber 104 via three communication paths 8A, 8B and 8C each located at the central part of each air chamber segment. Since the ink liquid chamber 104 is constructed in the above-described manner, the ink pressure transmitted from the liquid chamber 104 via the communication paths 8A, 8B and 8C during ink ejection can be absorbed in a plurality of air regions 71A, 71B, 72A, 72B, 73A and 73B (see FIG. 6) located in the vicinity of the communication paths 8A, 8B and 8C. Specifically, the ink pressure transmitted in that way is conducted and then absorbed in a first air region section including the air regions 71A and 71B located on the opposite sides relative to the communication path 8A, a second air region section including the air regions 72A and 72B located on the opposite sides relative to the communication path 8B and a third air region including the air region 73A and 73B located on the opposite sides relative to the communication path 8C.

Figure 6A:
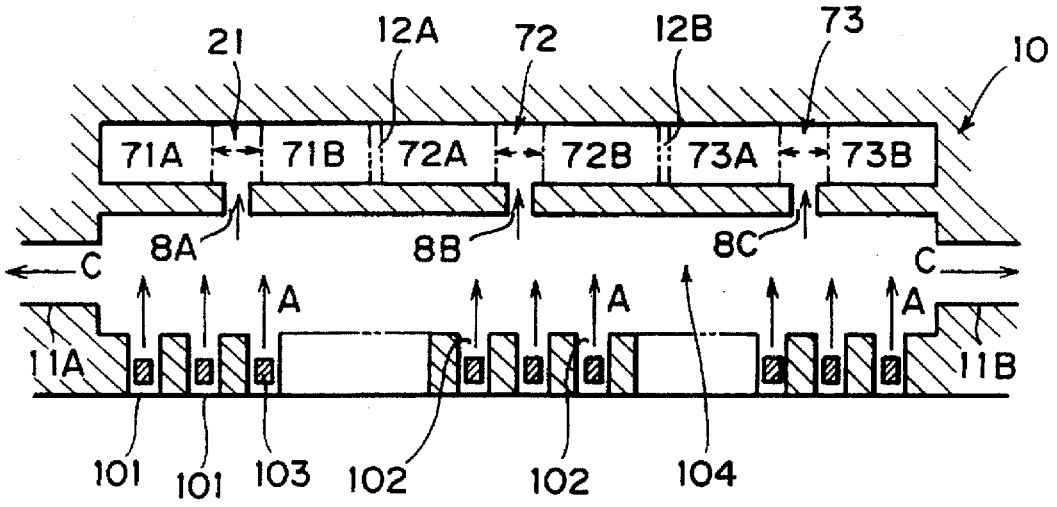
FIGS. 6A and 6B are fragmentary sectional plan views of the ink jet head shown in FIGS. 5A and 5B, particularly showing a behavior of ink at the time of ink ejection.
Figure 6B:
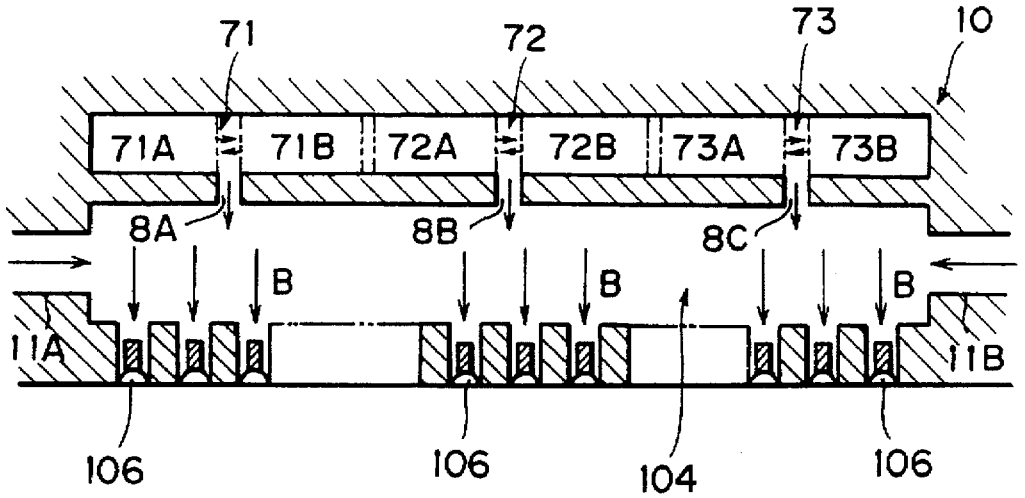

Next, a manner of absorbing the ink pressure will be described below with reference to FIGS. 6A and 6B. Since the behavior of ink in the liquid chamber 104 during ink ejection has been described above in the first embodiment of the present invention, repeated description is omitted. In this embodiment, on completion of ink ejecting, the power effective for squeezing ink away from the respective liquid paths 102 in the direction of arrow A is applied to the liquid chamber 104 as shown in FIG. 6A. In this embodiment, the foregoing power is dispersively or distributively transmitted to air chambers 71, 72 and to 73 depending on the state of ink injection, and thereafter, absorbed in the air regions 71A and 71B of the air chamber 71, the air region 72A and 72C of the air chamber 72, and the air regions 73A and 73B of the air chamber 73. At the time of subsequent ink ejection, as shown in FIG. 6B, the power absorptively reserved in the air chambers 71, 72 and 73 is transmitted to the liquid chamber 104, and thereafter, it is applied to the respective liquid paths 102 in the direction of arrow B. Since the thus applied power cooperates with the surface tension appearing on each meniscus 106 so as to allow the resultant power to function as a power for returning ink to the respective liquid paths 102, a sufficient quantity of ink for achieving subsequent ink ejection can be supplemented to the respective liquid paths 102.

As described above, in this embodiment, a plurality of communication paths are formed between the central part of the air chamber and the common liquid chamber both of which extend in parallel to each other in the longitudinal direction of the second base board 3, so that plural sets of air regions are formed on the opposite sides of each communication path, and moreover, the communication paths are located at the positions remote from the ink supply routes. Thus, a behavior of ink at the time of ink ejecting can effectively be controlled, and an ink refilling operation can smoothly be achieved for the respective ink paths. The structure of the ink jet head employed according to the second embodiment of the present invention is preferably employable especially in the case that a number of ink ejection outlets and ink liquid paths are formed in the longitudinal direction.

Figure 7:
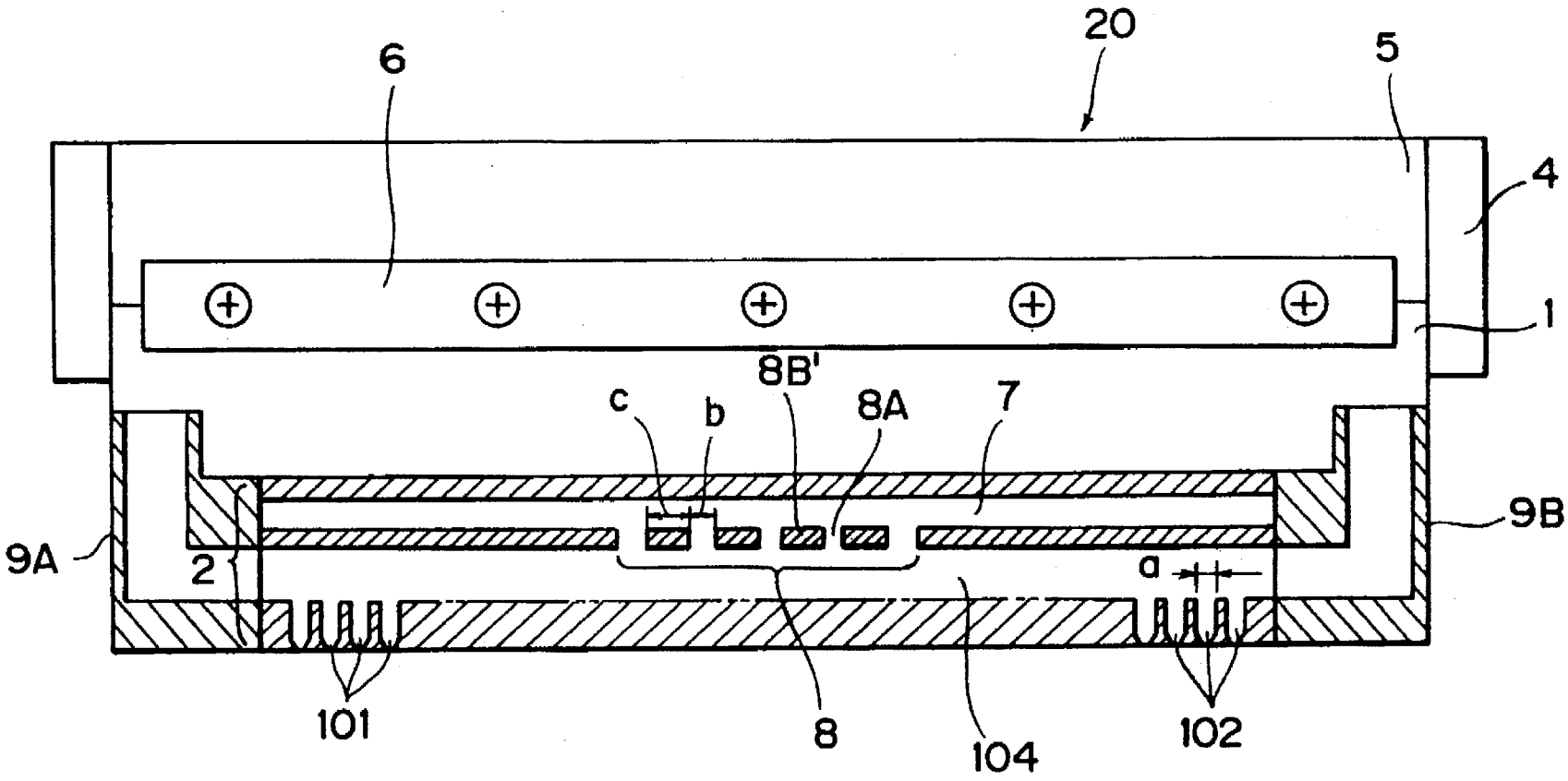
FIG. 7 is a fragmentary sectional plan view of an ink jet head constructed according to other embodiment of the present invention, particularly showing the structure of the ink jet head taken along a line 2/5A/7—2/5A/7 in FIG. 1.

Next, the structure of an ink jet head preferably employable for effectively absorbing ink vibration and pressure waves induced at the time of ink ejecting will be described below. Here, the ink jet head is exemplified by the structure as shown in FIG. 7. Alternatively, the structure of the ink jet head shown in FIG. 5 may be employed.

FIG. 7 is a fragmentary sectional plan view of an ink jet head constructed according to a modified embodiment of the present invention, particularly showing that a single air chamber 7 is arranged in parallel with a common liquid chamber 104. In this drawing, reference numeral 8 designates a communication portion which is disposed at the substantially central part of the ejection head 20 as seen in the longitudinal direction. In this embodiment, the communication portion 8 includes a plurality of communication paths 8A arranged in the longitudinal direction. Reference numeral 8B' designates a communication path forming wall which has two communication paths 8A, 8A located adjacent thereto. Also, in this embodiment, the common communication chamber 104 is designed to have a sufficiently large capacity compared with the air chamber 7. In the case that the ink jet head 20 includes a plurality of communication paths 8A for a single air chamber 7, to assure that the pressure generated toward the common liquid chamber 104 side at the time of ink ejecting through a number of ink paths 102 is quickly absorptively received, it is recommended that the number of communication paths or the total sectional area of the latter is increased.

In view of the foregoing fact, a series of development works were conducted for increasing the number of communication paths 8A. It was found based on the results obtained from the development works that a width of each communication path forming wall 8B' became excessively narrow, and moreover, a first base board 1 was readily be peeled away from a second base board 3 at a part of the communication path forming wall 8B' constituting the solid layer 2 due to shortage of the strength.

To eliminate the foregoing problems, a series of experiments as noted below were conducted to determine optimum conditions for the communication paths 8A and the communication path forming walls 8B' in the communication portion 8. For the purpose of convenience, a preset height of each ink ejection liquid path 102 is designated by h1, a preset width of the same is designates by a, a preset height of each communication path 8A is designated by h2 and a preset width of the same is designated by b, and a preset width of each communication path forming wall 8B' is designated by c. Specifically, in this embodiment, the sectional area of ink liquid path is represented by a h1 and the sectional area of the communication path is represented by b h2. Table 1 shows main comparison items of recording heads A, B and C used for the experiments.

TABLE 1

| name of head | number of liquid paths | width of liquid path (μm) | height of liquid path (μm) | pitch of liquid path | number of communication paths (μm) | width of communication path (μm) | height of communication path (μm) | width of communication path forming wall (μm) |
|---|---|---|---|---|---|---|---|---|
| A | 4736 | 38 | 24 | 400 dpi | 20 | 1000 | 24 | 1000 |
| B | 2048 | 65 | 48 | 203 dpi (8 pel) | 16 | 1000 | 48 | 1000 |
| C | 1472 | 42 | 24 | 360 dpi | 14 | 500 | 24 | 500 |

A function and a mechanical strength of the communication portion 8 were examined with respect to all the experiment recording heads, and after completion of the examination, it was confirmed that both the items were satisfactorily acceptable. In association with structural conditions for the communication portion 8, the following two inequalities are established.

1. $a \cdot h1 \leqq b \cdot h2$
2. $b \leqq c$

With the recording head 20 constructed in the above-described manner, ink vibration and pressure waves can be absorbed more effectively, and moreover, each liquid path 102 can be refilled smoothly with ink in a short time. This makes it possible to increase a response frequency and largely contributes to practical realization of high speed recording.

Next, an ink jet head constructed according to the third embodiment of the present invention will be described below with reference to FIG. 8. The recording head 30 includes a communication portion 8 of which communication path 8A is dimensioned to have a height h2 higher than a height h1 of each liquid path 102. In this case, the recording head 30 can easily be fabricated by equalizing the height h2 of the communication path 8A to a height of the solid layer 2, i.e., a thickness of the same when the solid layer 2 is formed as will be described later. In this embodiment, if the width b of the communication path 8A is set to be equal to the width a of the liquid path 102, an effective refilling effect can be expected by satisfying the condition that a sectional area, that is, b h2 of the communication path 8A is set to be larger than a sectional area a h1 as represented in the above inequality 1.

Next, an ink jet head constructed according a modified embodiment of the present invention modified from the second embodiment of the same will be described below with reference to FIG. 9A to FIG. 9C wherein the arrangement or shape of each communication path 8A is designed to be suitable for an ink refilling operation. Specifically, in the modified embodiment shown in FIG. 9A, a plurality of communication paths 8A formed at the substantially central part of a common liquid chamber 104 and an air chamber 7 are not arranged with an equally spaced relationship but as shown in the drawing, a width of each communication path forming wall 8B' is widened from the central part toward the opposite sides. Reference characters C1 to C3 designate a width of each communication path forming wall 8B' and reference character b designates a width of the communication path 8A. As is apparent from the drawing, the width C3 of the outer communication path forming wall 8B' is dimensioned to be larger than the width C2 of the intermediate communication path forming wall 8B', and the width C2 of the intermediate communication path forming wall 8B' is dimensioned to be larger than the width C1 of the central communication path forming wall 8B'. With this construction, the pressure generated in the liquid paths 102 located remote away from the central part of the recording head 20 is conducted to the air chamber 7 via the communication path 8A located in the vicinity of the foregoing liquid paths 102 so as to enable the original ink paths 102 to be refilled with ink.

Figure 9A:
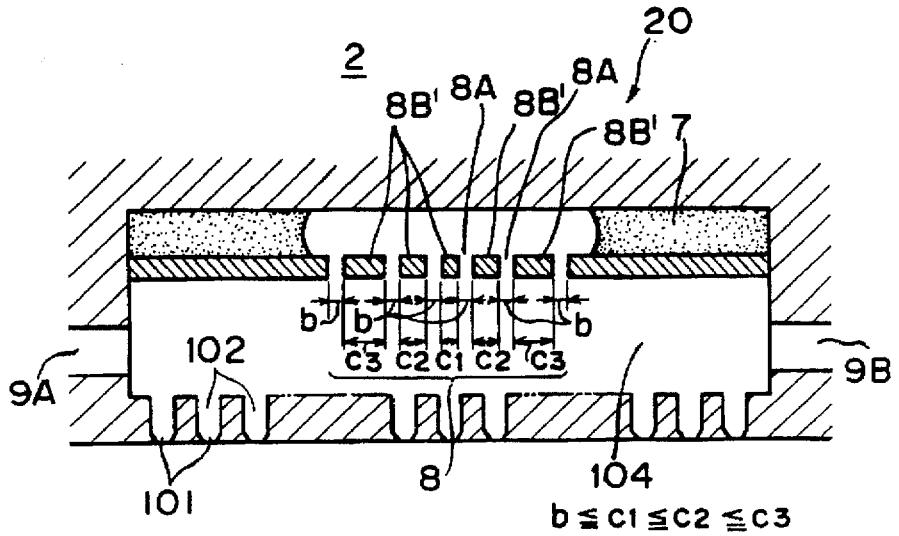
FIGS. 9A, 9B and 9C are fragmentary sectional plan views of an ink jet head constructed according to a modified embodiment of the present invention, respectively.
Figure 9B:
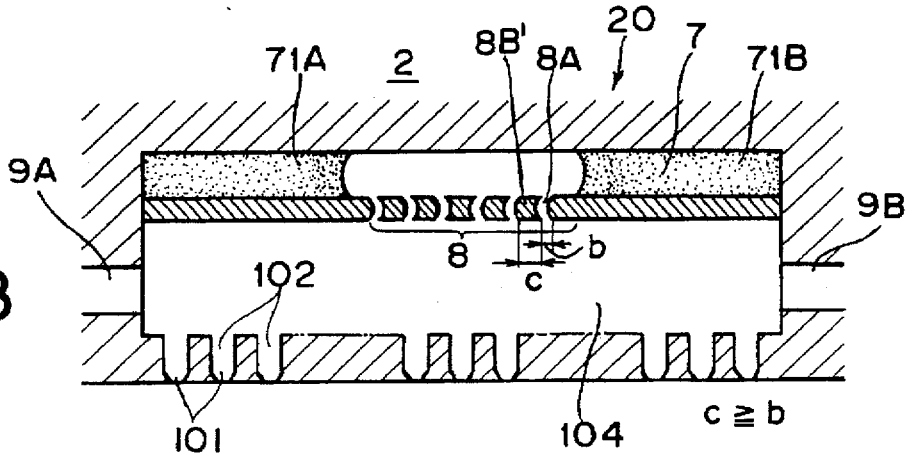
Figure 9C:
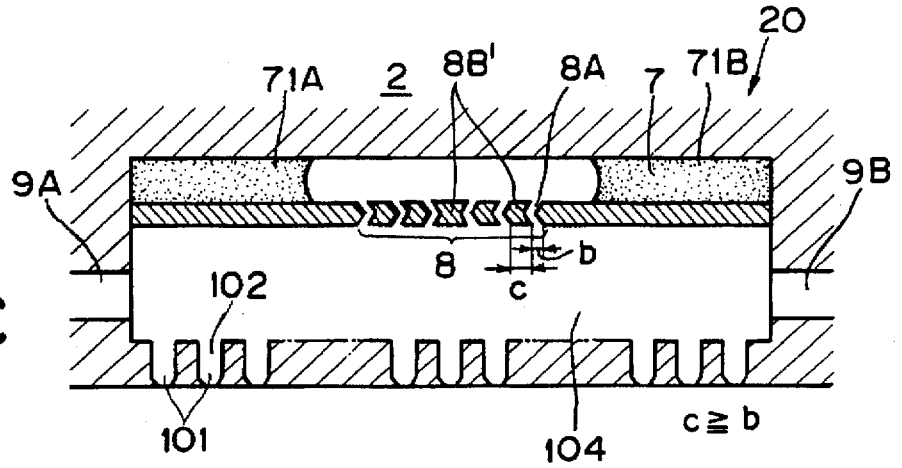

FIG. 9A and FIG. 9B illustrate the case that a sectional shape of each communication path forming wall 8B' is modified in such a manner that the opposite end surfaces of each communication path forming wall 8B' are configured to exhibit a U-shaped contour (FIG. 9B) or a V-shaped contour (FIG. 9C) in the symmetrical relationship relative to the central communication path 8A. With this construction, the pressure generated in the respective liquid paths 102 is easily conducted to the opposite air regions 71A and 71B of the air chamber 7 via the U-shaped or V-shaped communication paths 8A, and thereafter, it is possibly uniformly returned to the liquid chamber 104 side. An advantage obtainable form the modified embodiment is that the strength of the communication portion 8 and associated portions can be increased by contouring the respective communication path forming wall 8B' in that way.

Next, a more acceptable contour of the communication portion in the modified embodiment will be described below.

Figure 8:
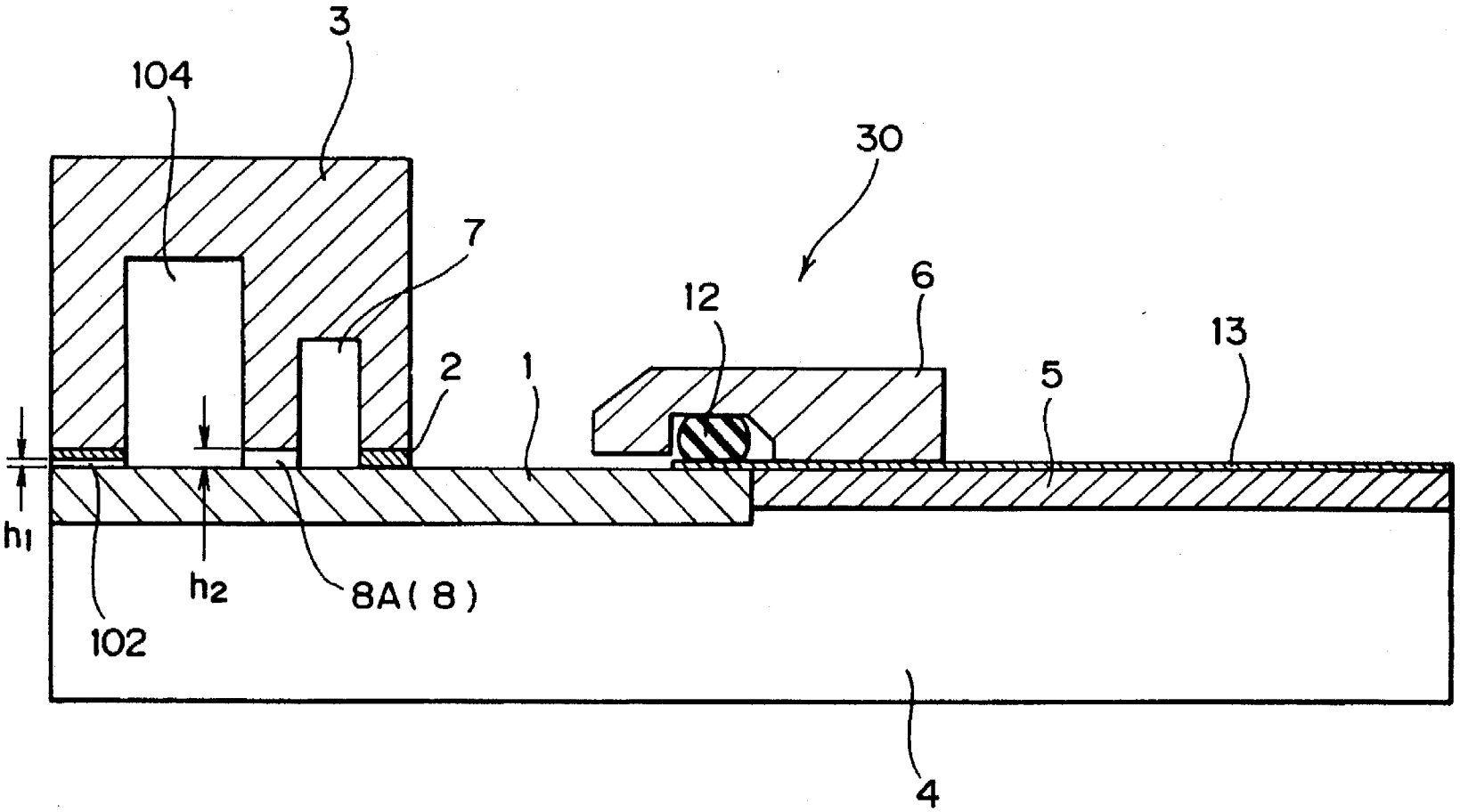
FIG. 8 is an enlarged vertical sectional view of the ink jet head shown in FIG. 7, particularly showing the structure of the ink jet head taken along a line 3/5B/8—3/5B/8 in FIG. 1.

For example, with the structure of the recording head 20 as shown in FIG. 7 and FIG. 8, on the assumption that the number of liquid paths 102 is designated by n, a width of the same is represented by a, that a height of the same is represented by h1, and that the number of communication paths 8A is designated by m, a width of each communication path 8A is represented by b and a height of the same is represented by h2, the liquid paths 102 and the communication paths 8A are constructed in such a manner as to establish the following inequality under a condition that the conditions shown in the second embodiment are satisfied.

$$m \cdot b \cdot h2 \geqq \tfrac{1}{10} \cdot n \cdot a \cdot h1 \qquad (3)$$

Incidentally, the reason why the inequality (3) is established will be described on the basis of the results obtained from the experiments conducted by the inventors as will be described later.

TABLE 2

| name of experimental head | number of liquid paths n | width of liquid path a (μm) | height of liquid path h1 (μm) | pitch of liquid path | n.a.h1 (μm) | number of communication paths m | width of communication paths b (μm) | height of communication paths h2 (μm) | pitch of communication paths (μm) | m.b.h2 (μm) | quality of printing |
|---|---|---|---|---|---|---|---|---|---|---|---|
| A1 | 4736 | 38 | 24 | 400 dpi | $4.32 \times 10^6$ | 64 | 40 | 24 | 400 dpi | $6.14 \times 10^4$ | X |
| A2 | 4736 | 38 | 24 | 400 dpi | $4.32 \times 10^6$ | 10 | 1000 | 24 | 2000 | $2.4 \times 10^5$ | X |
| A3 | 4736 | 38 | 24 | 400 dpi | $4.32 \times 10^6$ | 15 | 1000 | 24 | 2000 | $3.6 \times 10^5$ | Δ |
| A4 | 4736 | 38 | 24 | 400 dpi | $4.32 \times 10^6$ | 20 | 1000 | 24 | 2000 | $4.8 \times 10^6$ | 0 |

Specifically, the inventors conducted a series of experiments at a driving frequency higher than that during an ordinary recording operation using experimental articles A1 to A4 of recording heads of which the number of communication paths is represented by m, the width of which is represented by b and the height of which is represented by h2 as shown in Table 2. It was found from the results obtained from the evaluation on a quality of each recording operation that the experimental articles of recording heads A1 and A2 exhibited slight fluctuation in a quality of recording, the experimental articles of recording head A3 exhibits an excellent quality of recording, and the experimental article of recording head A4 exhibits a more excellent quality of recording operation. Subsequently, the inventors prepared experimental articles of recording heads A4, B and C as shown in Table 3 with reference to the results obtained from the results on a quality of each preceding recording operation and then conducted experiments again using the experimental articles of recording heads A4, B and C. On completion of the experimental recording operations, it was found that each of the experimental articles of recording heads A4, B and C exhibited an acceptable quality of recording operations.

TABLE 3

| name of experimental head | number of liquid paths n | width of liquid path a (μm) | height of liquid path h1 (μm) | pitch of liquid path | 1/10 (n.a.h1) (μm) | number of communication paths m | width of communication paths b (μm) | height of communication paths h2 (μm) | pitch of communication paths (μm) | m.b.h2 (μm) |
|---|---|---|---|---|---|---|---|---|---|---|
| A4 | 4736 | 38 | 24 | 400 dpi | $4.32 \times 10^5$ | 20 | 1000 | 24 | 2000 | $4.80 \times 10^5$ |
| B | 2048 | 65 | 48 | 203 dpi (8 pel) | $6.39 \times 10^5$ | 16 | 1000 | 48 | 2000 | $7.68 \times 10^5$ |
| C | 1472 | 42 | 24 | 360 dpi | $1.48 \times 10^5$ | 14 | 500 | 24 | 1000 | $1.68 \times 10^5$ |

Next, a recording head constructed according to another embodiment of the present invention will be described below. This embodiment is likewise concerned with a total sectional area of communication paths forming a communication portion and a total sectional area of liquid paths. In this embodiment, a quantity of ink ejected every ejection is substituted for the number of communication paths and a sectional area of the latter are set in association with the quantity of ejected ink.

To look for set conditions, a quantity of ejected ink was detected using experimental articles of recording heads A4, B and C each constructed in the same manner as shown in Table 3. The results obtained from the detection are shown in Table 4.

TABLE 4

| name of head | number of liquid paths n | width of liquid path (μm) | height of liquid path (μm) | pitch of liquid path | volume of ink droplet V (pl) | k.v.n | number of communication paths m | width of communication path b (μm) | height of communication paths h2 (μm) | pitch of communication paths (μm) | m.b.h2 ($\mu m^2$) |
|---|---|---|---|---|---|---|---|---|---|---|---|
| A4 | 4736 | 38 | 24 | 400 dpi | 30 | $2.84 \times 10^5$ | 20 | 1000 | 24 | 2000 | $4.80 \times 10^5$ |
| B | 2048 | 65 | 48 | 203 dpi (8 pel) | 180 | $7.37 \times 10^5$ | 16 | 1000 | 48 | 2000 | $7.68 \times 10^5$ |
| C | 1472 | 42 | 24 | 360 dpi | 40 | $1.18 \times 10^5$ | 14 | 500 | 24 | 1000 | $1.68 \times 10^5$ |

K: 2($\mu m^2$/pl)

The results obtained from evaluation on a quantity of recording using the experimental articles of recording heads A4, B and C as shown in Table 4 are same as those described with reference to Table 3. Thus, the relationship represented by the following inequality (4) was obtained based on a quantity of ejected ink (pl; coefficient of converting volume into area) as shown in Table 4.

$$m \cdot b \cdot h2 > k \cdot V \cdot n \quad (4$$

where k is a coefficient used for converting ink ejection volume into area and, in this embodiment determined to be the value of $2(\mu m^2/pl)$ on the basis of the result of several kinds of experiments, and V is quantity of ink ejected from a single ejection outlet every single ejection.

According to a fifth embodiment of the present invention, the number of communication paths 8A, a width of the same and a height of the same are set in such a manner as to settle the inequality (4).

Next, a method of producing an ink jet head according to the present invention will be described in below.

FIG. 10 shows by way of fragmentary sectional view that number of ink liquid paths 102 and a mold member 20 for forming a communication portion 8 are disposed on a first base board 1 including number of energy generating portions 103 (e.g., heat generating resistance elements or ejection heaters each serving to feed thermal energy to ink in the shown case) and circuits (not shown) for driving the ink ejecting energy generating portions 103. In this embodiment, the mold member 20 is represented by a plurality of hatched lines in the drawing and contoured in the form of a convex portion. The white part of the first base board 1 in the drawing is an upper surface of the same, and a plurality of a concave portion 21 each serving as a column portion 8B of the communication port 8 are formed on the white part of the first base board 1 at a subsequent step. Thus, the first base board 1 is visually recognized below the mold member 20. In this embodiment, the mold member 20 is formed in the location other than that corresponding to the ink liquid paths and the communication portions but the formation of the foregoing location is not always required. In practice, the mold member 20 is removed from the first base board 1 at a subsequent step.

A material and means employed for the forming the mold member 20 will concretely be described below.

(1) The mold member 20 is formed using a photosensitive dry film in accordance with a so-called dry film image forming process.

(2) A solvent soluble polymer layer having a predetermined thickness and a photoresist layer are laminated on the first base board 1 one above another, and after a pattern is formed on the photoresist layer, the solvent soluble polymer layer is selectively removed from the first base board 1.

(3) A resin layer is formed on the first base board 1.

A positive type dry film or a negative type dry film can be employed as a photosensitive dry film as explained in the paragraph (1). For example, a preferably employable positive type dry film is such that it can be dissolved in a developing liquid by irradiating active energy rays thereto, while the negative dry film is prepared in the form of a photo-polymerizable type negative film which can be dissolved or removable peeled in a methylene chloride or a strong alkaline solution.

The positive type dry film is exemplified by "OZATEC R225" (trade name, manufactured by Hoechst Japan Co. Ltd.), while the negative type dry film is exemplified by "OZATEC T series" (trade name, manufactured by Hoechst Japan Co., Ltd.), "PHOTOEC PET series" (trade name, manufactured by Hitachi Kasei Kogyo Co., Ltd.) and "RISTON" (trade name, manufactured by Dupont de Nemours Co., Ltd.). In addition to the foregoing commercial products, it of course is obvious that a positively active resin compound, e.g., a resin component containing naphkinondiamide derivative and a novolac type phenol resin as main components, negatively active resin compound, e.g., a compound containing acrylorigomar having acrylester as an reactive group, thermoplastic high molecular compound and a sensitizer as main components, and a compound containing polyol, a polyethylene compound and a sensitizer are also employable.

As a solvent soluble polymer as explained in the paragraph (2), any type of high molecular compound is employable, provided that a solvent having the foregoing polymer dissolved therein is available and a film can be formed thereon by employing a coating process. A photoresist layer employable for the solvent soluble polymer can typically be exemplified by a positive type photoresist containing a novolac type phenol resin and naphtokinondiadid, a negative type liquid photoresist comprising a polyvinylsinarmate, a negative type photoresist containing a cyclic rubber and a bisadid, a negative type photosensitive dry film, a thermoses type ink, and an ultraviolet ray setting type ink.

In addition, a material employable for forming the mold member 20 by employing a printing process is exemplified by a flat plate ink, a screen ink and a transferable type resin each of which is usable as a vaporization drying type, a thermoses type or an ultraviolet ray setting type.

Among a group of materials as mentioned above, it is preferable from the viewpoint of a machining accuracy, ease of removal, an operational i efficiency that means having a photosensitive dry film used therefor is employed, and moreover, it is especially preferable from the same viewpoint that means having a positive type dry film used therefor is employed. Specifically, the positive type photosensitive material is most preferably employable from the viewpoint of forming a number of liquid paths 102, since it is superior to the negative type photosensitive material in respect of resolution, and moreover, it has an advantageous feature that a side wall surface of which relief pattern extends vertically and smoothly or a sectional shape having a tapered type or a reversely tapered type can easily be formed. Additionally, since the positive type photosensitive material has another advantageous feature that the relief pattern can removably be dissolved in a developing liquid and an organic solvent, it is preferably employable as a material for forming the mold member. Especially, since the positive type photoresist including novolac type phenol resin and naphtokinon diadid as noted above is completely dissolved in a weak alkaline aqueous solution or alcohol, there does not arise a malfunction that each energy generating element (ejection heater) 103 is injured or damaged therewith, and moreover, a subsequent removing step can be achieved very quickly. Thus, a dry film-shaped positive type photosensitive material having a film thickness ranging from 10 μm to 100 μm can be noted as a most preferable material.

Subsequently, after the mold member 20 is disposed or formed on the first base board 1, a filling member 22 is laminated on the mold member 20 in such a manner as to cover the mold member 20 therewith, and the filling member 22 is filled in at least a concave portion of the mold member 20.

Any type of filling material is preferably employable, provided that the mold member 20 can be covered therewith.

Since the filling material is a structural material employable for the liquid eject recording head 10 having number of liquid paths 102 and a liquid chamber 104 formed therein, it is desirable to select the filling material having excellent adhesiveness to the base board, a high mechanical strength, excellent dimensional stability and excellent corrosion resistance. Materials each hardenable when it is irradiated with active energy rays such as ultraviolet rays, visual light beam, X-rays, infrared rays, electron beams or the like while it is held liquid are suitably employable. Particularly, they are exemplified by epoxy resin, acrylic resin, diglycol-dialkyl carbonate resin, unsaturated polyester resin, polyurethane resin, polyimido resin, melamine resin, phenol resin, and urea resin. Especially, epoxy resin capable of starting to effect cation polymerization in receipt of light beam, acryl oligomars each having an acrylic ester group capable of starting to effect radical polymerization in receipt of light beam, light additive polymerizable type resin having polyol and polyethylene used therefor, and unsaturated cyclo-acethal resin are suitably employable as structural materials for an ink jet recording head.

A method of ejecting a filling material from a plurality of nozzles arranged corresponding to the contour of a base board, a method of handling an applicator, a method of handling a curtain coater, a method of handling a roll coater, a method of handling a spray coater and a method of handling a spin coater can typically be noted as typical methods each for laminating the filling member 22 on the mold member 20. In the case that the mold member 22 is laminated with a liquid hardenable material, it of course is obvious that the liquid hardenable material is deaerated prior to lamination in order to avoid inclusion of gas bubbles in the hardened laminated material.

Figure 10A:
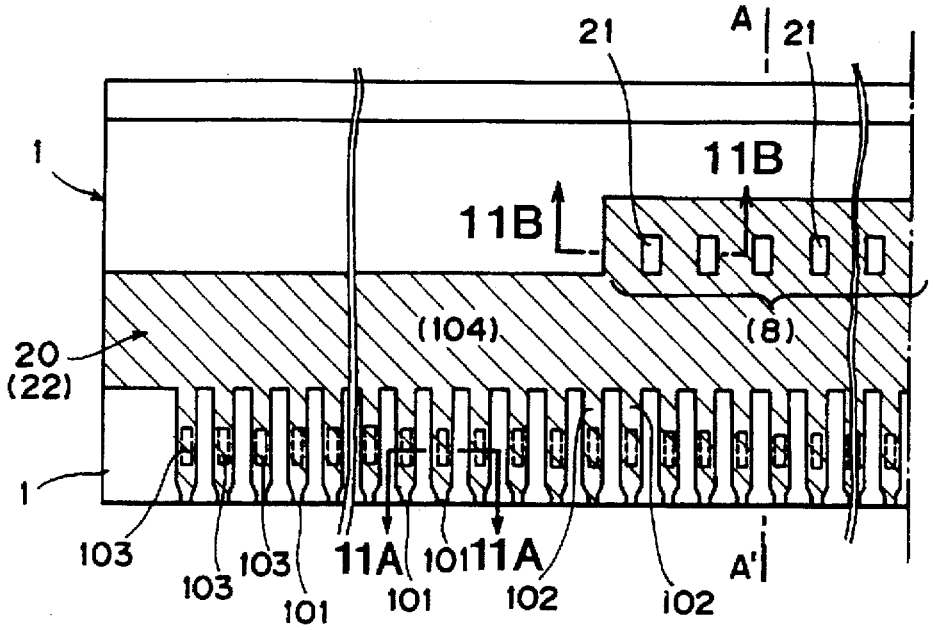
FIG. 10A is a fragmentary sectional plan view of an ink jet head, particularly showing the state that a mold member is placed on a first base board by employing a method of producing the ink jet head according to the present invention.
Figure 10B:
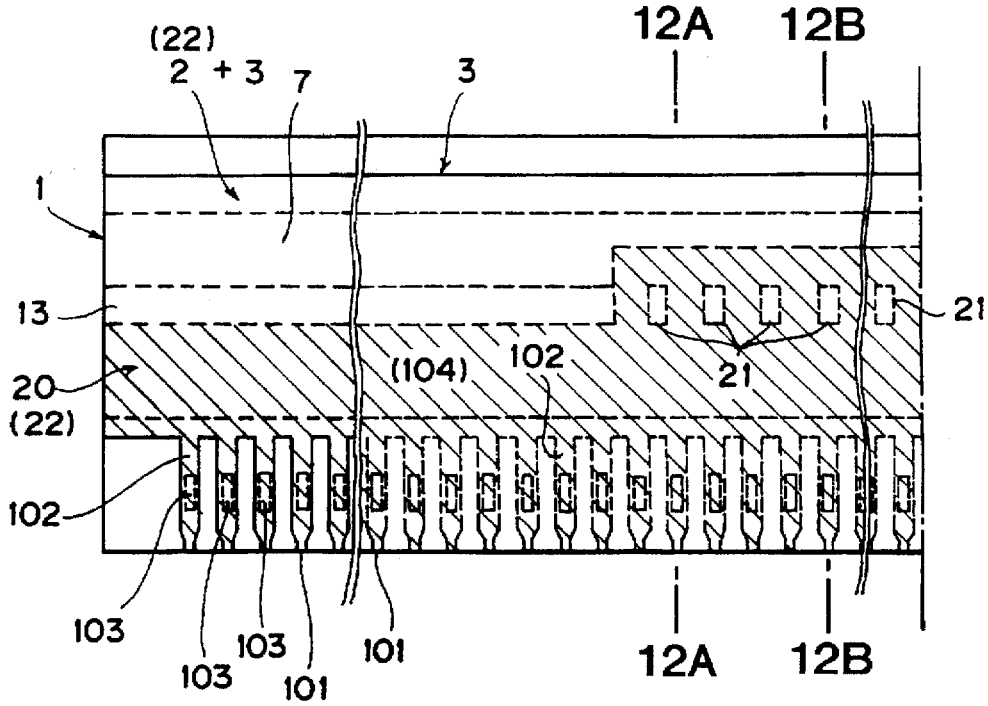
FIG. 10B is a fragmentary sectional plan view of the ink jet head, particularly showing the state that a second base board is placed on the first base board with a filling member interposed therebetween by employing the method of the present invention.
Figure 11A:
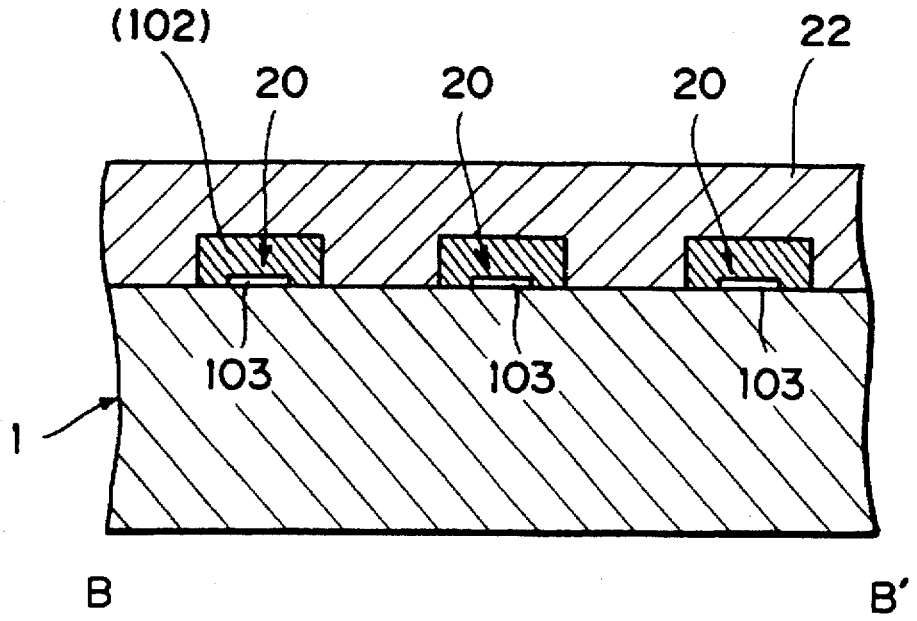
FIGS. 11A and 11B are enlarged fragmentary vertical sectional view of the ink jet head taken along a line 11A—11A and a line 11B—11B in FIG. 10A, respectively.
Figure 11B:
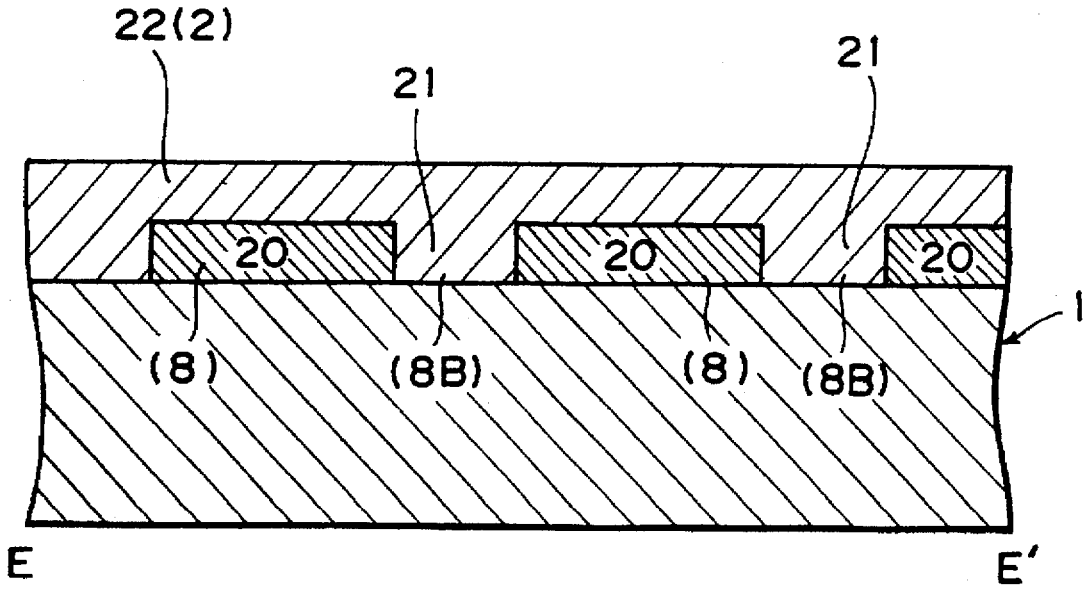

FIG. 11A is an enlarged sectional view of the base board 1 filled with the filling material 22 taken along a line 11A—11A in FIG. 10A, and FIG. 11B is an enlarged sectional view of the same taken along a line 11B—11B in FIG. 10A. The respective mold members 20 are dissolved at a subsequent step so that they become cavities. The mold members 20 shown in FIG. 11A become ink liquid paths 102. On the other hand, the mold members 20 shown in FIG. 11B become communication paths 8 by way of which first grooves are communicated with second grooves for forming an air chamber 7. Mold member disposing portions 21 shown in FIG. 10 become columns 8B' between the adjacent communication paths 8 at a step after they are filled by the filling member 22.

Subsequently, a second base board 3 having two grooves formed therein is connectably placed on the first base board 1. FIG. 10B is a plan view which shows that the first base board and the second base board are laminated one above another. A significant fact to be taken into account is that a partition wall portion 13 between the two grooves are formed in such a manner as to cover the concave portion 21 therewith. At this time, the inner walls of the two groove on the first base board 1 have been coated with a shading layer made of a material having light shading capability against active energy rays effective for hardening the filled member 22 as will be described later. A method of dipping the first base board 1 in a shading layer solution so as to allow it to be coated therewith, and thereafter, wiping off predetermined fixed parts such as the concave portion 21 or the like and a method of adhering a masking tape to parts on the first base board 1 having no shading layer required thereon, and thereafter, dipping the first base board 1 so as to allow a necessary part of the latter to be coated therewith can be noted as a method to be advantageously employed for the purpose of forming a shading layer. In addition, a metallic film spattering method, an etching method or the like may be employed.

Figure 12A:
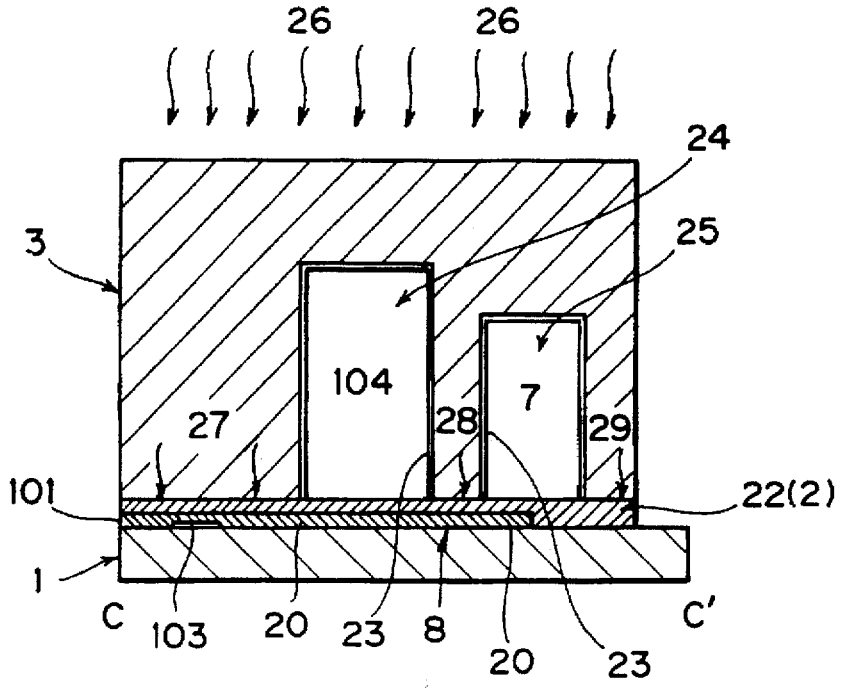
FIGS. 12A and 12B are enlarged fragmentary vertical sectional views of the ink jet head taken along a line 12A—12A and a line 12B—12B in FIG. 10B, particularly showing a step of irradiating active energy rays, respectively.
Figure 12B:
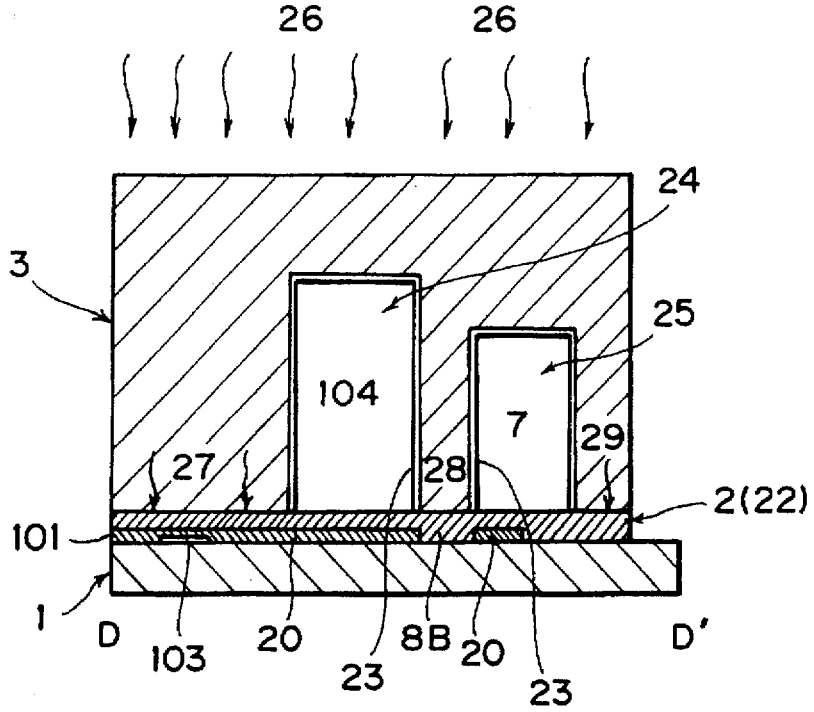

FIG. 12A is an enlarged sectional view of the first base board 1 and the second base board 2 taken along a line 12A—12A in FIG. 10B, and FIG. 12B is an enlarged sectional view of the first base board 1 and the second base board 2 taken along a line 12B—12B in FIG. 10B. As is apparent from these drawing, a shading layer 23 of the type as mentioned above is coated only on the inner wall of two grooves 24 and 25 of the second base board 3. In the case that active energy rays are reliably irradiated from above while maintaining the parallel relationship among them, it is acceptable that only a ceiling portion of each of the grooves 24 and 25 is coated with the shading layer 23. Incidentally, a portion which will later become an ink liquid path 102, a portion which will later become the ejection heater 103 and a portion which will later become the communication path 8 are included in the sectional plane extending along the line 12A—12A. On the other hand, a portion which will later become the ink path 102, a portion which will later become the ejection heater 103 and a portion which will later become the column 8B are included in the sectional plane extending along the line 12B—12B. When active energy rays 26 are irradiated from above while maintaining the foregoing state, they invade in a front wall, a partition wall and a rear wall so that the photosensitive filled member 22 is hardened. As a result of the setting of the photosensitive filled member 22, the bottom wall of a front wall 27, the bottom wall of a partition wall 28 and the bottom wall of a rear wall 29 in the first base board 1 are adhesively connected to the second base board 3 via the hardened solid layer 2.

Ultraviolet rays, visual light beam, X-rays, infrared rays, electron beams can be utilized as active energy rays. In view of the fact that exposure is achieved with the active energy rays 26 which have permeated through the first base board 1, ultraviolet rays and visual light beam are preferably employable. Among them, ultraviolet rays are most suitably employable as active energy rays from the viewpoint of a polymerization speed. Although processing can be achieved at a high accuracy when a power source for generating few heat is used, any type of conventional light source can be utilized, provided that it is practically used for the purpose of producing a printing plate, handling a printed circuit or hardening a photo-setting type paint.

Figure 13A:
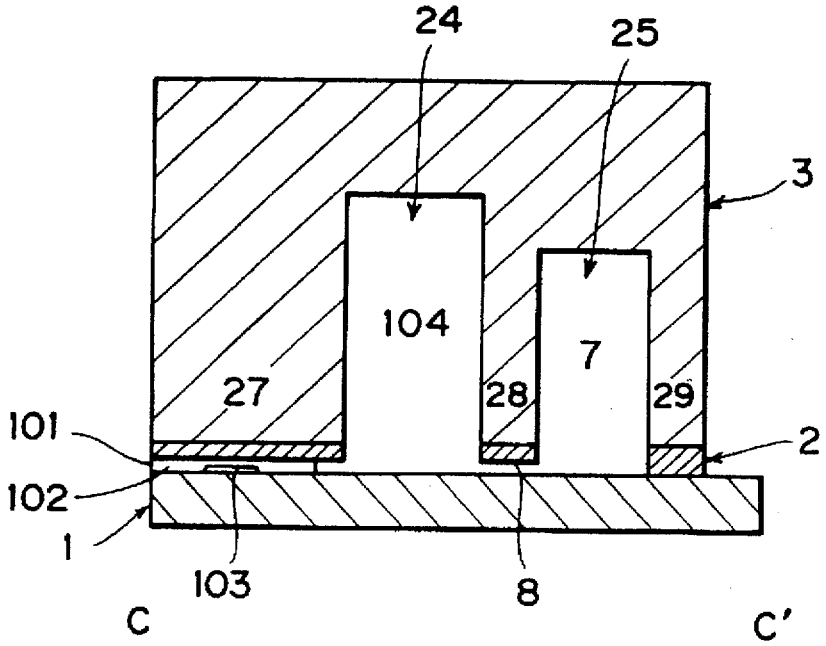
FIG. 13A is an enlarged fragmentary vertical sectional view of the ink jet head shown in FIG. 12A, particularly showing the state that the mold member is removed therefrom.
Figure 13B:
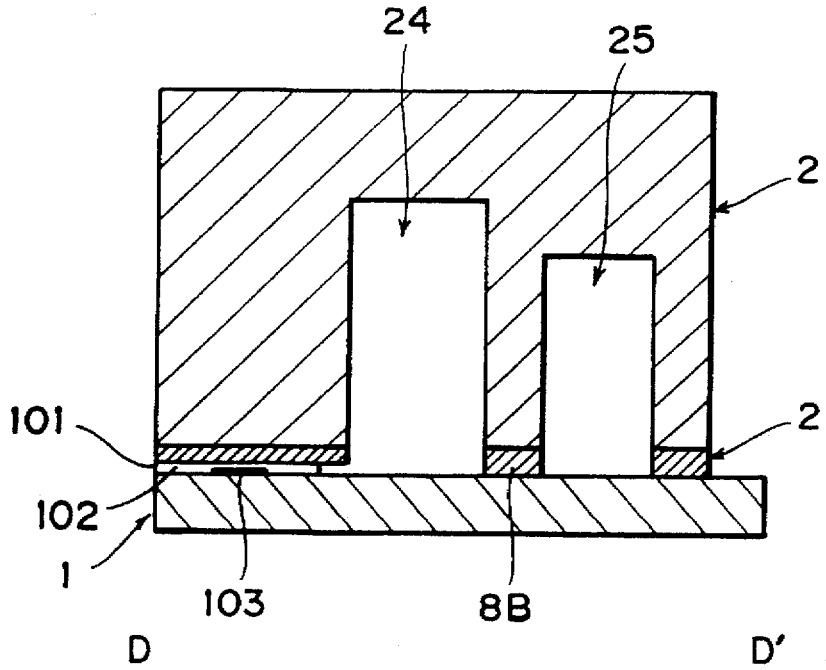
FIG. 13B is an enlarged fragmentary vertical sectional view of the ink jet head shown in FIG. 12B, particularly showing the state that the filling member is removed therefrom.
Figure 14:
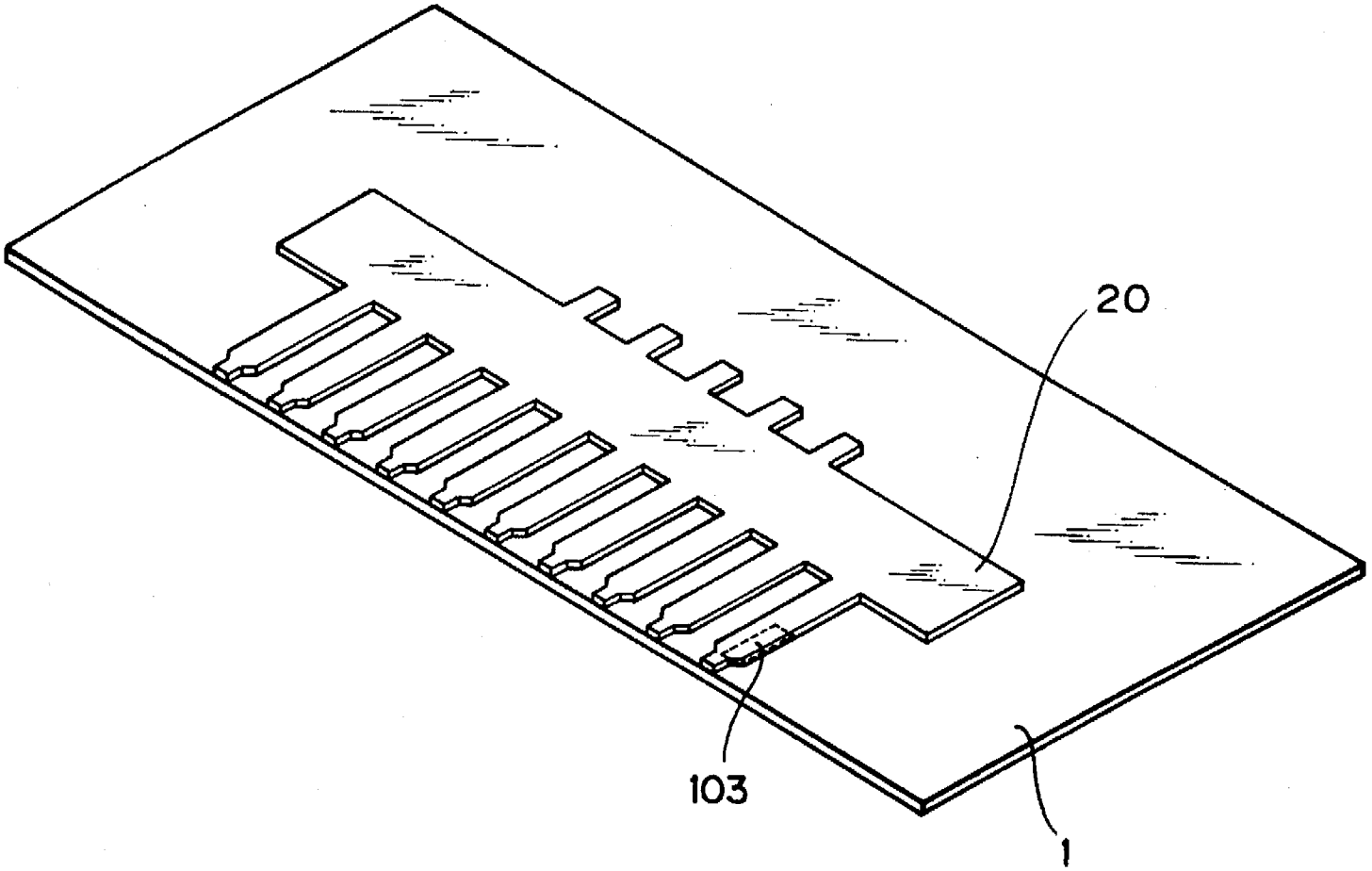
FIG. 14 is a perspective view of the ink jet head, particularly showing the intermediate state that a mold member layer is placed on the first base board by employing the method of the present invention.

After completion of the irradiation of the active energy rays 26, the mold member 20 and an unhardened part of the filled member 22 are removed from the laminated structure so that the state of the laminated structure shown in FIGS. 12A and 12B is shifted to that shown in FIGS. 13A and 13B so as to form the ink liquid path 102, the communication path 8 and the column 8B.

To remove the mold member 20 and the unhardened part of the filled member 22, it is desirable to employ a process of dipping the laminated structure in a liquid capable of dissolving, expansibly swelling or peelably removing them therefrom. Halogen-containing hydrocarbon, ketone, ester, aromatic hydrocarbon, ether, alcohol, N-methylpyroridon, dimethyl formaldehyde, phenol, water, acid-containing water or alkali-containing water can be noted as means for removing the mold member 20 and the filled member 22. A surface active agent may be added to each of the aforementioned liquids as desired. In the case that a positive type dry film is used as a mold member, it is preferable that ultraviolet rays are additionally irradiated to the mold member to facilitate removable of the latter. In the case that other materials rather than the positive type dry film are used, it is preferable that they are heated to the temperature range of 40° to 60° C.

As the mold member 20 and the unhardened part of the filled member 22 are dipped and subjected to chemical treatment, they are dissolutely removed from the ink ejection outlet 101, the ink feed port 30, the communication path 8 and the two grooves 24 and 25.

If there is no need of forming the active energy ray shading layer 23, a shading layer dissolving agent is additionally mixed with the foregoing dissolving/dipping liquid, resulting in the number of steps being reduced. It of course is obvious that the shading layer may be removed at a different step.

On completion of the aforementioned steps, the opposite ends of the two grooves in the laminated structure including the two base boards are communicated with the outside. Thus, ink feed tube connecting members 9A and 9B (see FIG. 1 and FIG. 2) are adhesively secured to the opposite ends of the two grooves, whereby an ink jet recording head is completed. At this time, to assure that the first groove 24, i.e., one of the two grooves is communicated with the ink feed tubes 11A and 11B and the second groove 25, i.e., the other one of the two grooves is sealably closed with a part of each of the connecting members 9A and 9B, the contour of each of the connecting members 9A and 9B is preliminarily designed so that the air chamber 7 is formed. Thus, the second groove 25 sealably closed with the connecting members 9A and 9B is communicated with the first groove 24 serving as a liquid chamber 104 only via the communication portion 8. Accordingly, when ink is introduced into the liquid chamber 104, the other region rather than the communication portion 8 aligned with the column 8B serves as an air reservoir. At this time, since the communication portion 8 serves as a kind of ink reservoir, this makes it possible to prepare for simultaneously eject ink from number of ink ejection outlets 101 at a high speed.

Next, a method of producing an ink jet head according to another embodiment of the present invention will be described below with reference to FIG. 14 to FIG. 18. In this embodiment, the method using more simply constructed mold member and using more simple steps is described. These drawings show the case that the method is applied to an ink jet head 20 shown in FIG. 7.

First, a mold member 20 is formed on a first base board 1 having a plurality of ejection heaters 103, a heater driving circuit (not shown) and others formed therein in the same manner as the preceding embodiment. The mold member 20 is formed in the region positionally corresponding to a common liquid chamber 104, a liquid path 102 and a communication path 8A of a communication portion 8 as shown in FIG. 7, and a manner of forming these components and materials employed for forming them are same as those in the preceding embodiment. In the preceding embodiment, a column 8B is built by forming the concave portion on the mold member 20. In contrast with the preceding embodiment, in this embodiment, a comb-shaped mold member is substituted for the concave portions.

Figure 15:
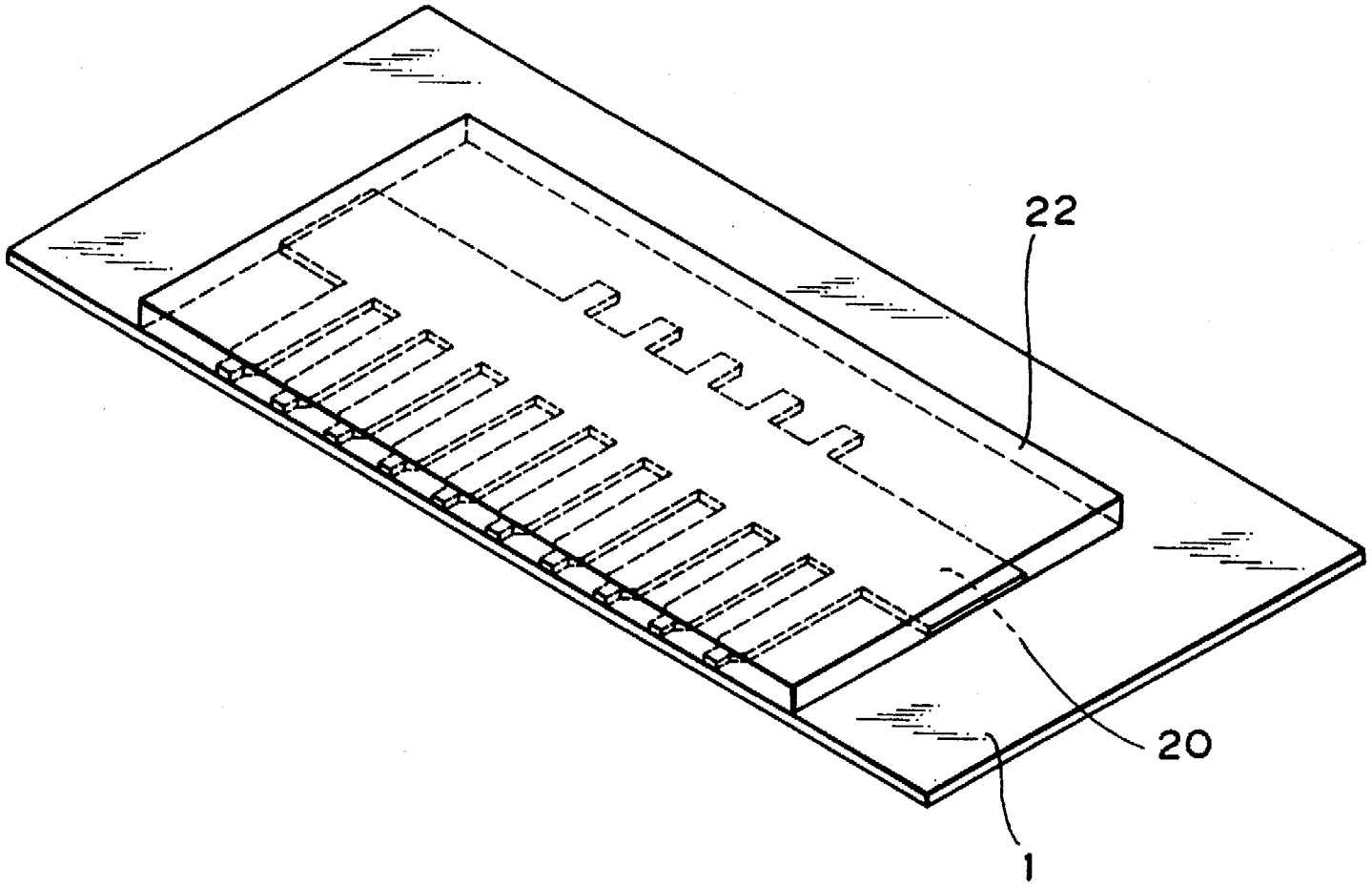
FIG. 15 is a perspective view of the ink jet head, particularly showing the intermediate state that a solid mold member layer is laminated on the mold member layer shown in FIG. 14 by employing the method of the present invention.
Figure 16:
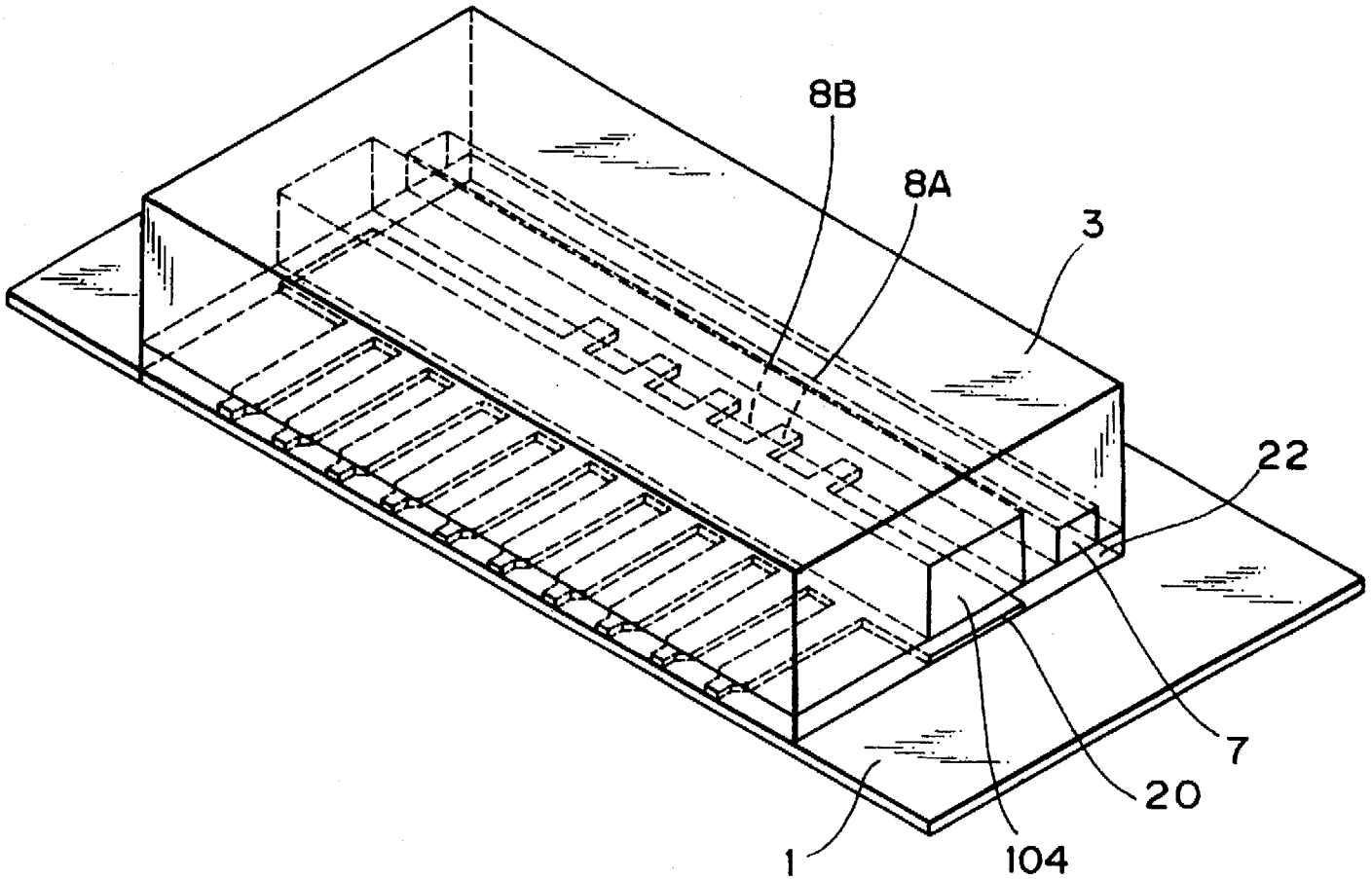
FIG. 16 is a perspective view of the ink jet head, particularly showing the intermediate state that a second base board is laminated on the solid mold member layer shown in FIG. 15 by employing the method of the present invention.
Figure 17:
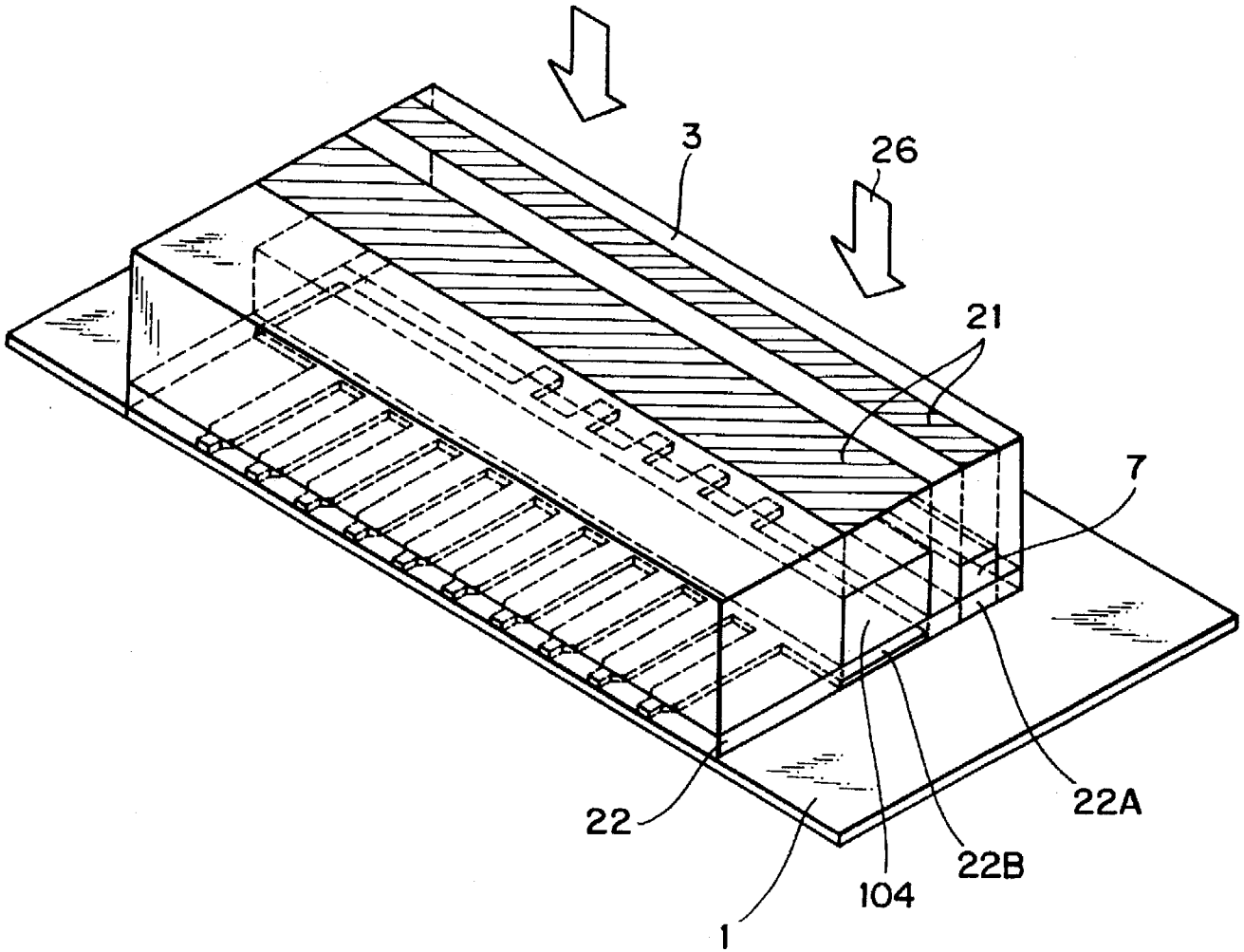
FIG. 17 is a perspective view of the ink jet head, particularly showing the intermediate state that a photo-mask is placed on a part of the second base board shown in FIG. 16 and active energy rays are irradiated then toward the second base board.

Subsequently, after the mold member 20 is formed in that way, a filled member layer 22 is formed on the mold member 20 in such a manner as to cover the mold member 20 therewith as shown in FIG. 15 using an active energy ray setting material such as an epoxy resin, an acrylic resin or the like. After the filled member layer 22 is formed in that way, a second base board 3 is laminated on the filled member layer 22 as shown in FIG. 16. It should be noted that a common liquid chamber 104 and an air chamber 7 are preliminarily formed in the second base board 3. In this embodiment, after the second base board 3 is laminated in that way, photo-masks 21 are adhesively placed on the second base board 3 as shown in FIG. 17 in the regions located directly above the common liquid chamber 104 and the air chamber 7 as shown in FIG. 17, and thereafter, active energy rays 26 are irradiated toward the photo-masks 21 in the arrow-marked direction from above.

In contrast with the preceding embodiment, since the photo-masks 21 are employed in this embodiment, there is no need of forming shading layers in a common liquid chamber and an air chamber. Thus, there arises a necessity for taking into account as to how ink is adversely affected by the material constituting the shading layers.

On completion of the irradiation of the active energy rays 26, only parts 22A and 22B of the filled member layer 22 positionally corresponding to the air chamber 7 and the common liquid chamber 104 are left unhardened but other part of the filled member layer 22 rather than the foregoing parts 22A and 22B are hardened. Subsequently, as represented by the arrow-marked directions in FIG. 18, the unhardened parts 22A and 22B of the filled member layer 22 are dissolutely removed from other opening portions of the common liquid chamber 104 and the air chamber 7 of which opposite ends are kept open in the second base board 3. In addition, to dissolutely remove the mold member 20, e.g., a halogen-containing hydrocarbon is introduced into the second base board 3 so that the dissolved part of the second base board 3 is discharged from the common liquid chamber 104 and the air chamber 7, whereby the common liquid chamber 104, the air chamber 7, the liquid paths 102 and the ink ejection outlets 101 can simultaneously be formed together with the communication portion 8.

As irradiation of the active energy rays 22 is performed in the above-described manner, the active energy rays 22 permeate through the filled member layer 22, causing the latter to be hardened. After completion of the hardening of the filled member layer 22, the bottom surface of a liquid path forming portion in the first base board 1, the bottom wall of a wall between the common liquid chamber 104 and the air chamber 7 and the bottom surface of a rear wall are adhesively connected to the second base board 3 via the hardened solid layer 2 (serving as a flow path forming member).

The same power source for irradiating the active energy ray 22 as that employed in the preceding embodiment can likewise be used as a power source for the same purpose.

Figure 18:
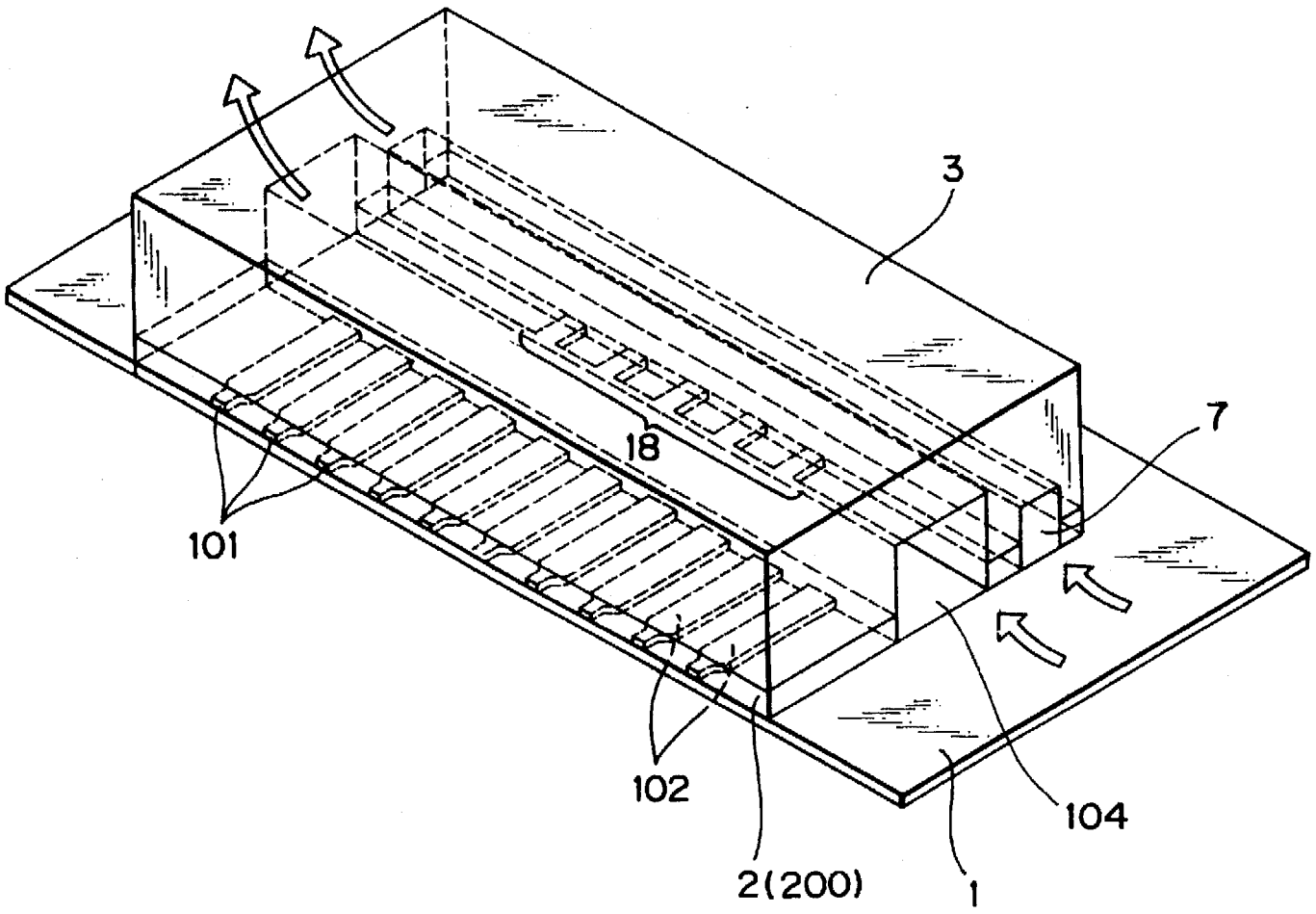
FIG. 18 is a perspective view of the ink jet head, particularly showing the intermediate state that an unhardened part and the mold member layer are dissolutely removed after the step shown in FIG. 17.
Figure 19:
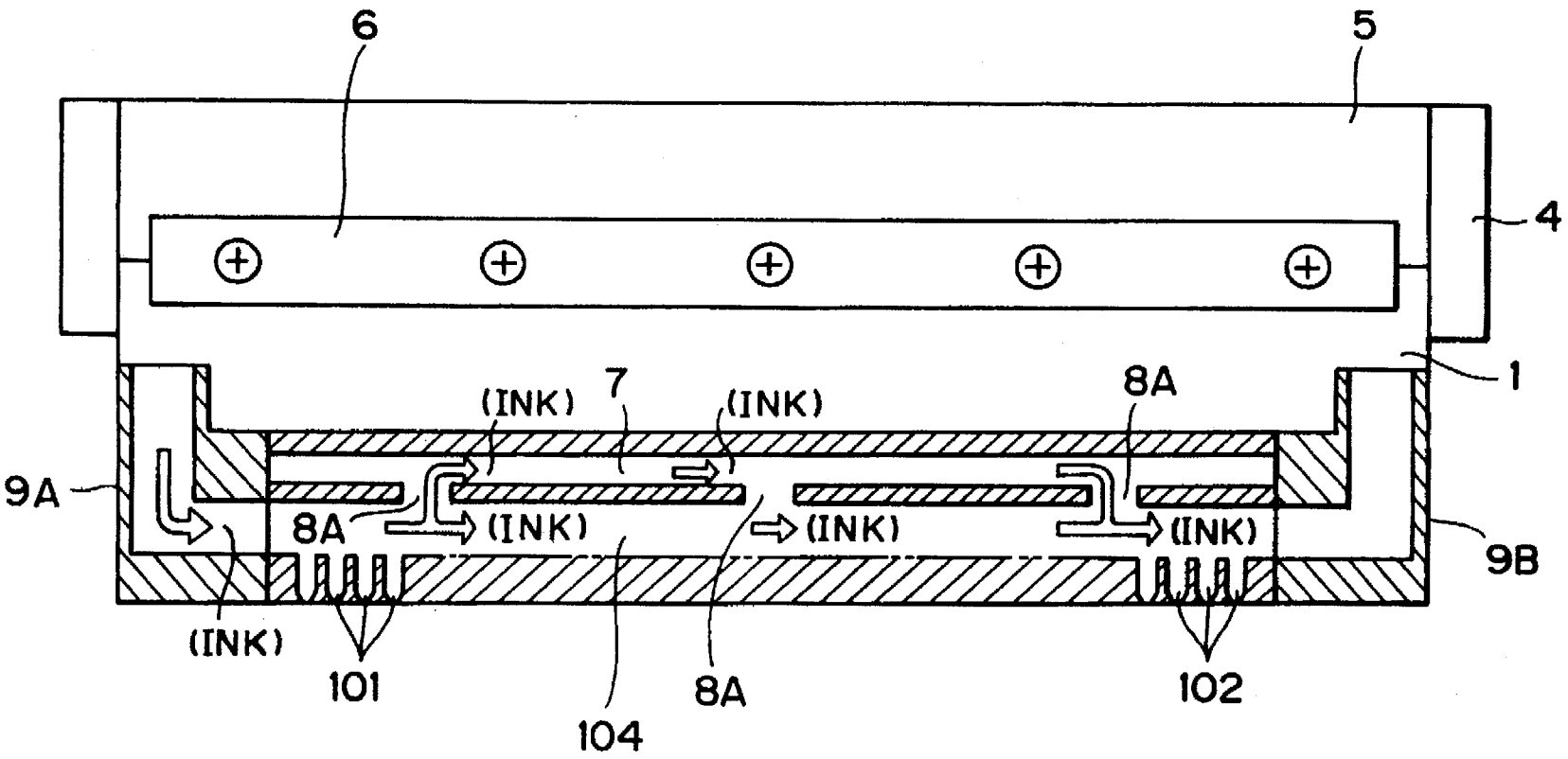
FIG. 19 is a sectional view of the ink jet head, particularly showing that a malfunction arises when ink is filled in a single air chamber through a plurality of communication paths.
Figure 20:
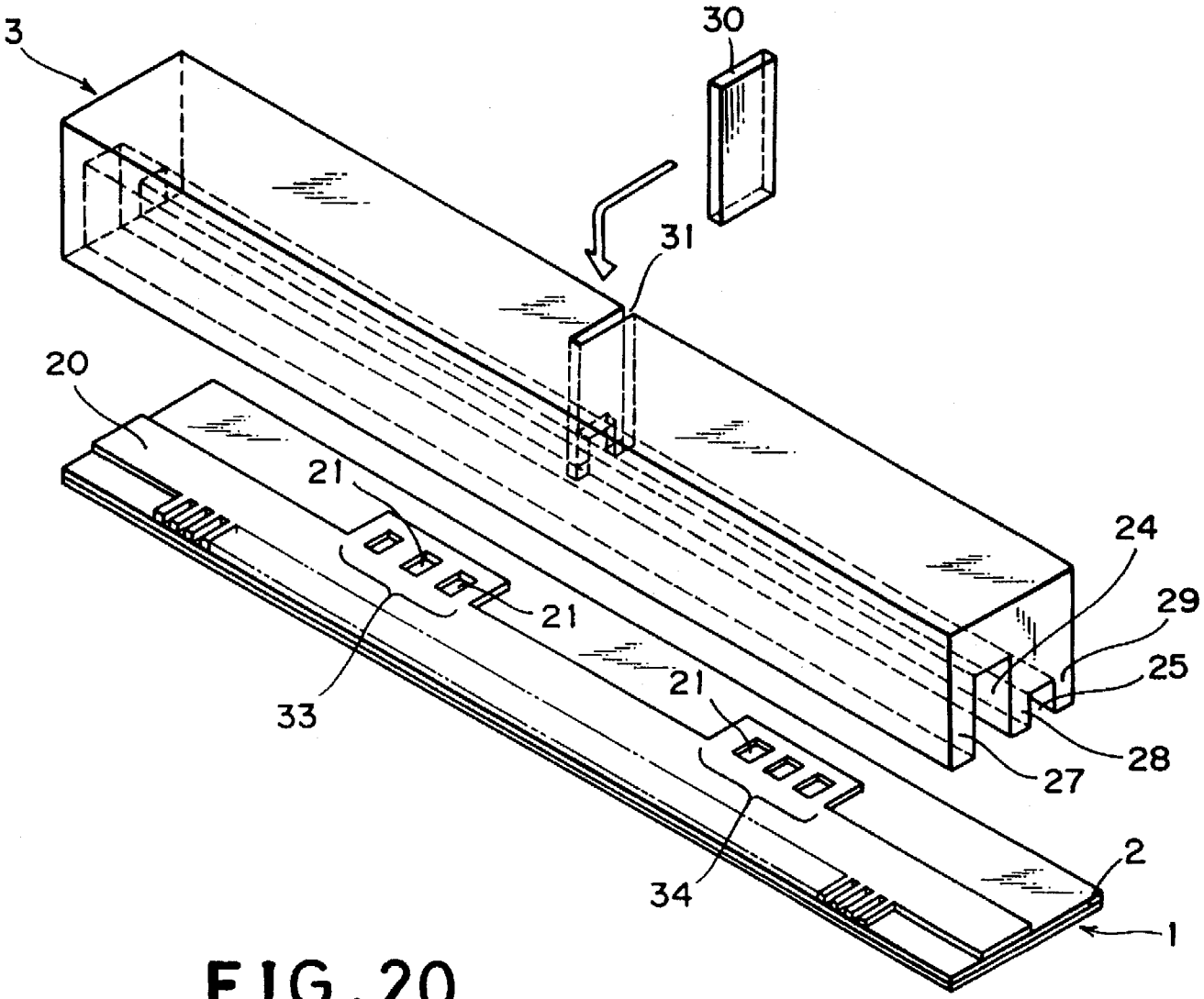
FIG. 20 is a perspective view of the ink jet head constructed according to another embodiment of the present invention, particularly showing the first base board and the second base board in the disassembled state.

After the laminated structure is built as shown in FIG. 18, the opposite ends of the air chamber 7 are sealably closed with sealing members and ink feed tubes 14A and 14B are fixedly secured to the opposite ends of the common liquid chamber 104 via ink feed joints 9A and 9B in the same manner as the preceding embodiment, whereby a desired ink jet head is obtained. Here, the reason why a plurality of communication paths 8A are concentratively arranged at the substantially central part of the ink jet head as seen in the longitudinal direction will be described below. Provided that a plurality of communication paths 8A are distributively arranged in the longitudinal direction of the air chamber 7 as shown in FIG. 19, when the common liquid chamber 104 is initially filled with ink as represented by arrow-marked directions, a certain amount of ink invades in the air chamber 7. This leads to the result that the air chamber 7 fails to exhibit a function as a buffer chamber. For this reason, it is necessary that a part of or some part of the air chamber 7 is designed in the form of a dead lane. To this end, in the case of an ink jet head as shown in FIG. 5, the air chamber 7 is divided into several sections using two partition members 12A so that communication paths 8A, 8B and 8C are formed at the substantially central parts of air chamber segments 7A, 7B and 7C. A method of producing an ink jet head of which air chamber 7 is divided into two parts will briefly be described below with reference to FIG. 20. A slit 31 is formed at the substantially central part of a second base plate 3 having a first groove 24 and a second groove 25 formed therein. It should be careful that the slit 31 does not extend in excess of a partition wall 28 to reach the first groove 24. A slitting operation is performed by actuating a rotary grinding wheel or operating a cutting machine capable of accurately machining a material with the aid of a rotary grinding wheel or a similar tool. A mold member 20 having a first communication path forming portion 33 and a second communication path forming portion 34 formed thereon is placed on a solid layer 2, and three holes 21 are formed at both the communication path forming portions 33 and 34 in which columns 8B for a communication path 8 are later formed. Subsequently, the communication path forming sections 33 and 34 are filled with a photosensitive filling agent (not shown). A first base board 1 and a second base board 3 are adhesively connected to each other by employing the aforementioned process, and unnecessary parts are then dissolutely removed from the laminated structure. Thereafter, a partition wall plate 30 is inserted into the slit 31 and then adhesively secured to the latter. Finally, ink feed pipe connecting members 9A and 9B are adhesively connected to the opposite ends of the second base board 2 by employing the aforementioned process, whereby two air chambers can be formed with a partition wall interposed therebetween. Thus, an ink jet head including two ink storage and four air storage can be constructed. Incidentally, each air chamber is communicated with the liquid chamber 104 via the corresponding communication path. The present invention should not be limited only to a single partition wall 30. Alternatively, two or more partition walls 30 may be used so as to form air chambers more than the aforementioned case. It of course is obvious that the number of communication path forming portions varies correspondingly.

Figure 5A:
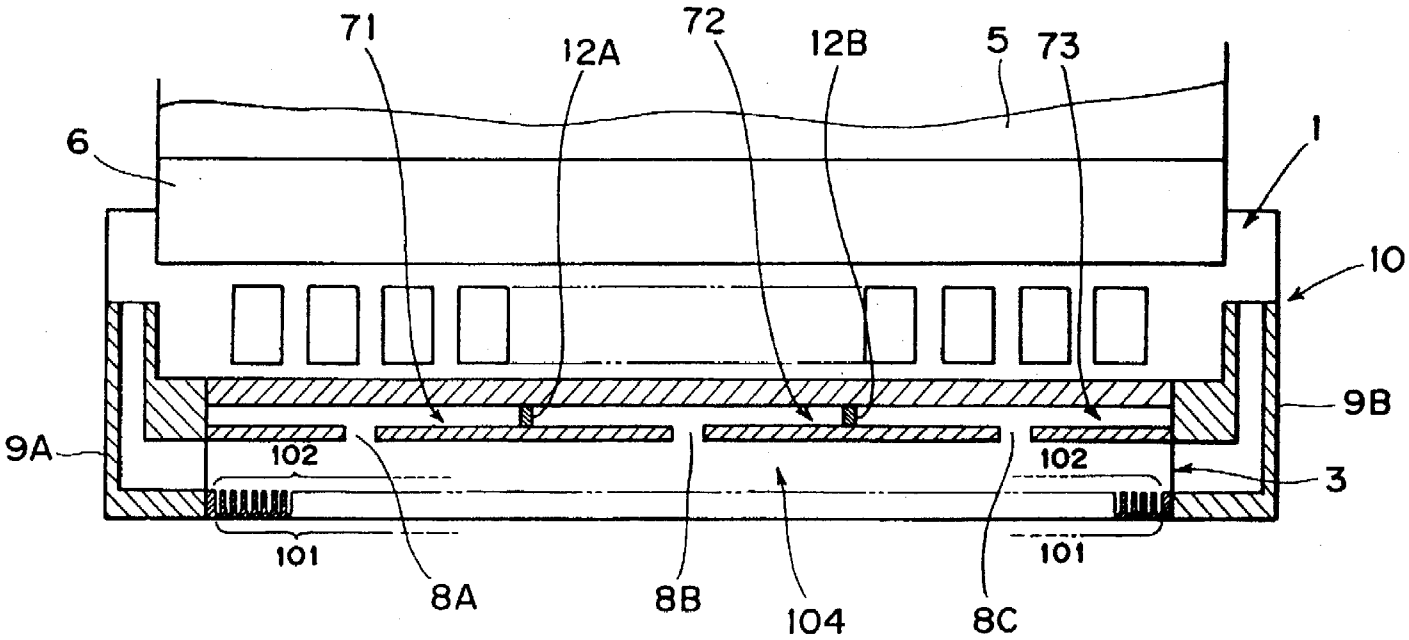
FIGS. 5A and 5B are fragmentary sectional plan views of an ink jet head constructed according an embodiment of the present invention, particularly showing the structure of the ink jet head taken along a line 2/5A/7—2/5A/7 and a line 3/5B/8—3/5B/8 in FIG. 1, respectively.
Figure 5B:
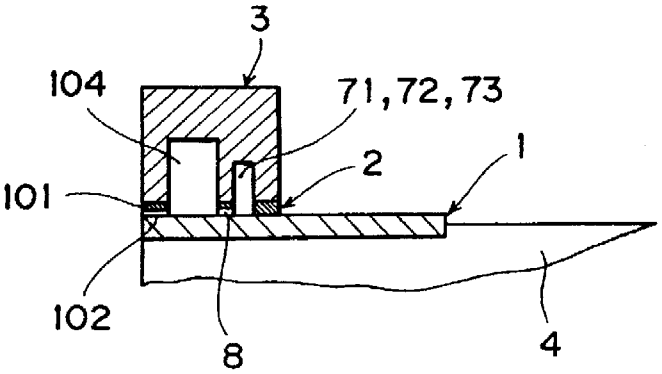

Next, a method of forming a plurality of partition members 11 in the case that an air chamber 7 is divided into plural chambers with each partition member 11 located between adjacent chambers for an ink jet head as shown in FIG. 5 will be described below with reference to FIG. 21 to FIG. 23.

Figure 21A:
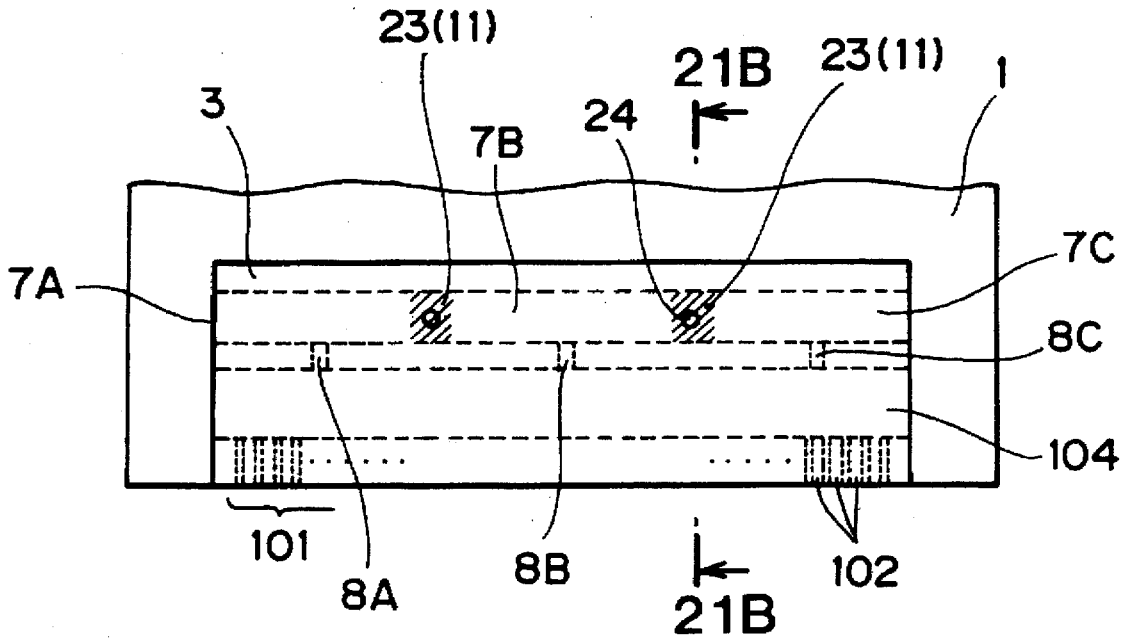
FIG. 21A is a fragmentary plan view of the ink jet head, particularly showing by way of example that plural air chambers are formed by using plural partition members.
Figure 21B:
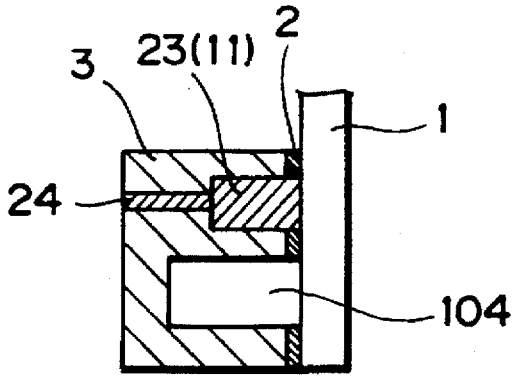
FIG. 21B is a vertical sectional view of the ink jet head taken along a line 21B—21B in FIG. 21A.

FIGS. 21A and 21B are views of an ink jet head which shows that two sealing agent filling holes 24 each serving to form a partition member 11 are preliminarily formed on a second base board 3 from above, and thereafter, a sealing agent 23 is injected through each filling hole 24 to form the partition wall 11 by solidifying the sealing agent 23. It should be noted that each filling hole can be formed on the second base board 3 by rotating a drill, irradiating a laser light beam or a supersonic jet toward the filling hole or employing a blasting process.

Figure 22A:
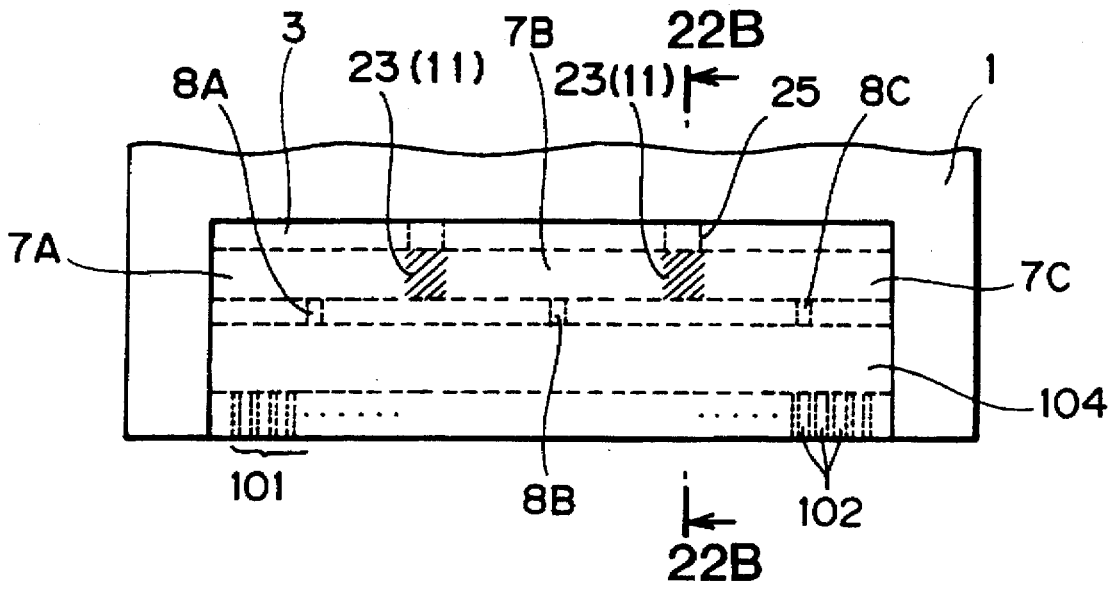
FIG. 22A is a fragmentary plan view of the ink jet head, particularly showing by way of other example that plural air chambers are formed by using plural partition members.
Figure 22B:
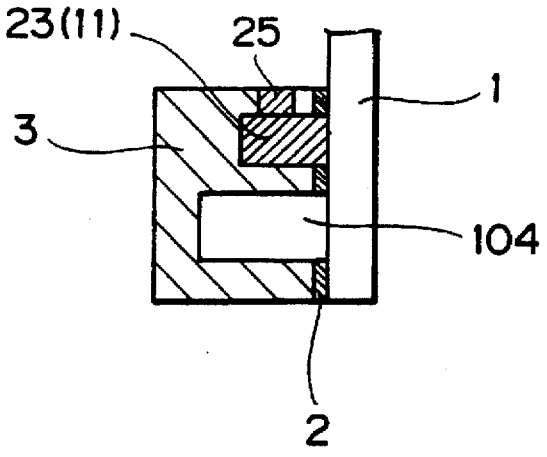
FIG. 22B is a vertical sectional view of the ink jet head taken along a line 22B—22B in FIG. 22A.

Similarly, FIGS. 22A and 22B are views of an ink jet head which show that two sealing agent filling holes 25 are formed in a second base board 3 from the rear side, and thereafter, a sealing agent 23 is injected through each filling hole 25 to form a partition member with the solidified sealing agent 23.

Figure 23:
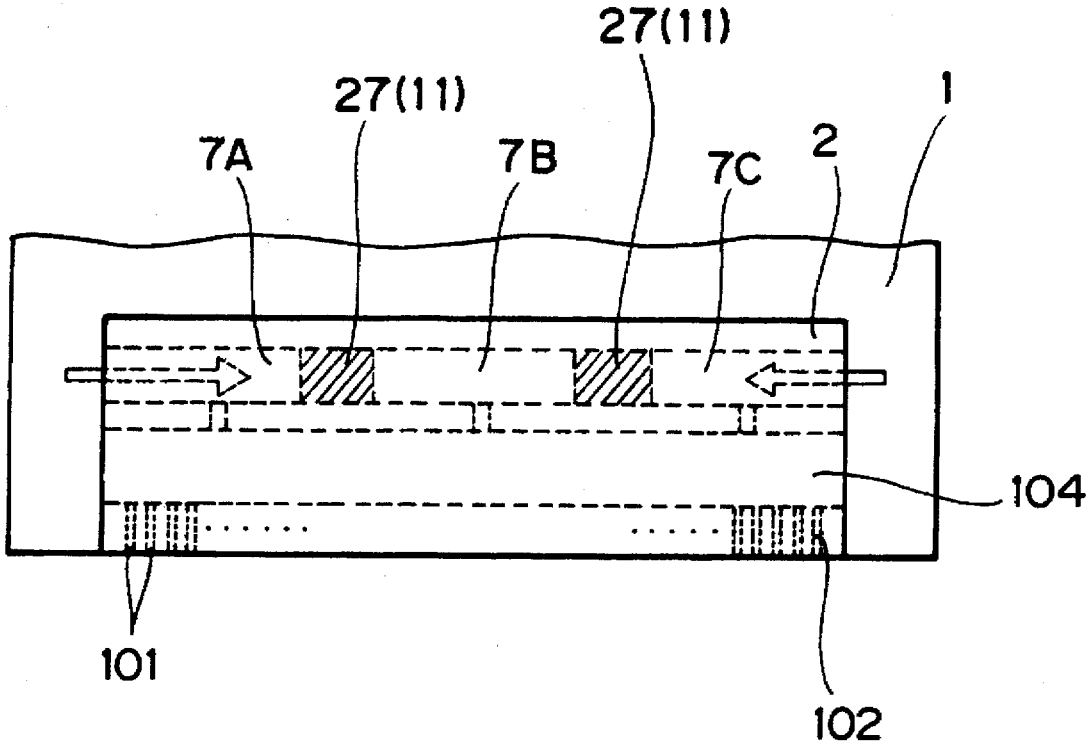
FIG. 23 is a fragmentary plan view of the ink jet head, particularly showing by way of another example that plural air chambers are formed by using plural partition members.

FIG. 23 is a fragmentary plan view of an ink jet head which shows the state that a second base board 3 is laminated on a first base board 1 via a solid layer 2 (see FIG. 18) wherein e.g., two elastic materials 27 are squeezed from the opposite open ends of an air chamber 7 in the arrow-marked direction to reach the position where two partition members 11 are formed with the elastic materials 27. Alternatively, squeezing holes formed on the upper surface of the second base board 3 may be substituted for the opposite open ends of the air chamber 7.

The present invention should not be limited only three air chambers defined according to the first embodiment of the present invention. In addition, i the present invention should not be limited to a single communication path 8A to be formed corresponding to individual air chamber. It of course is possible to form a communication path similar to the communication paths 8A to 8C formed according to the first embodiment by additionally employing the technique according to the second embodiment of the present invention.

Figure 24A:
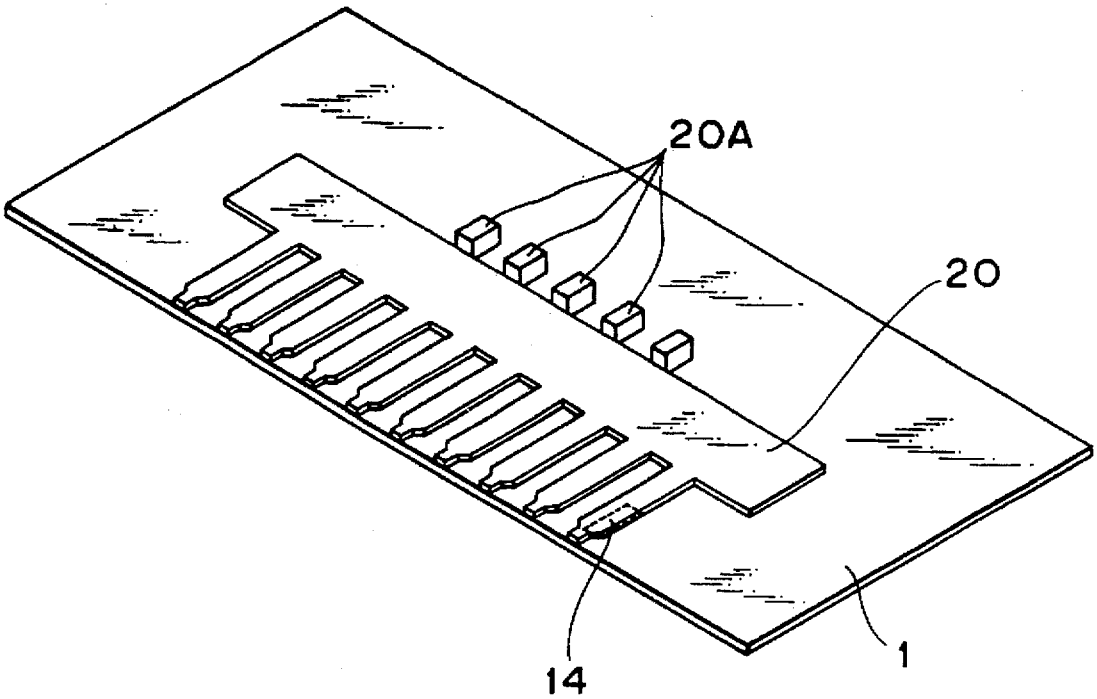
FIGS. 24A and 24B are perspective views of the ink jet head, particularly showing an intermediate step of the method of the present invention.
Figure 24B:
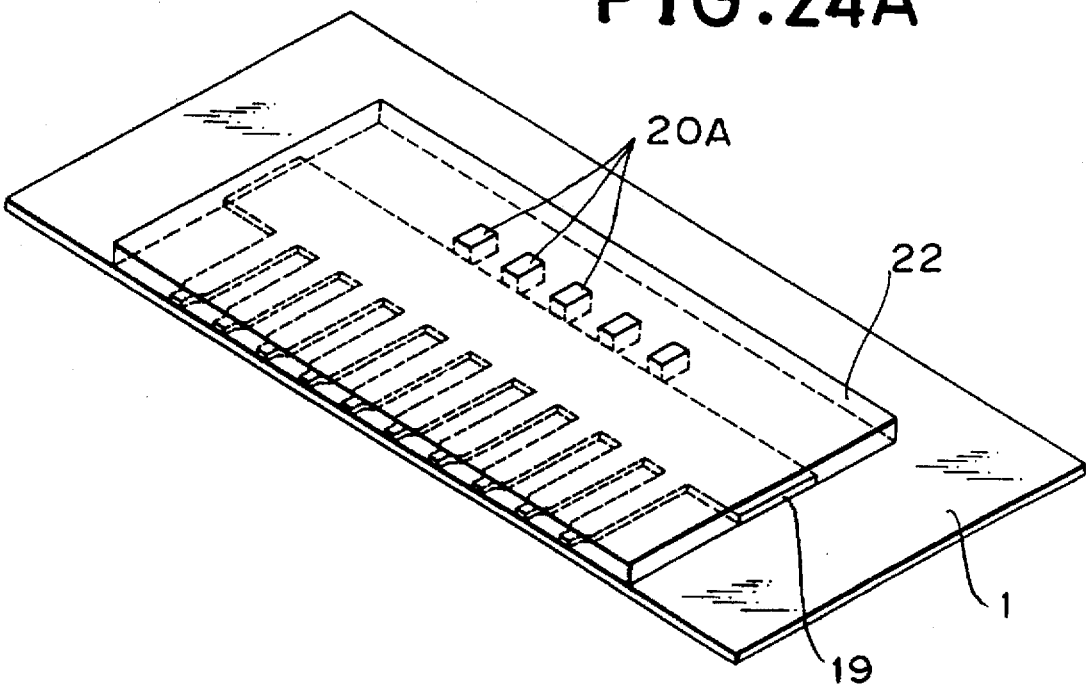

Next, a method of producing an ink jet head 30 shown in FIG. 8 will be described below with reference to FIGS. 24A and 24B. In this case, to form a mold member 20, the height of a communication path forming portion 20A is dimensioned to be equal to the thickness of a filled member layer 22 formed at a step as shown in FIG. 24B. Thus, as shown in FIG. 24B, when the filled member layer 22 is laminated on the mold member 20, the upper surface of the communication path forming portion 20A can positionally be coincident with the upper surface of the filled member layer 22. Subsequently, the ink jet head 30 as shown in FIG. 8 can be obtained by way of the aforementioned steps.

Figure 25:
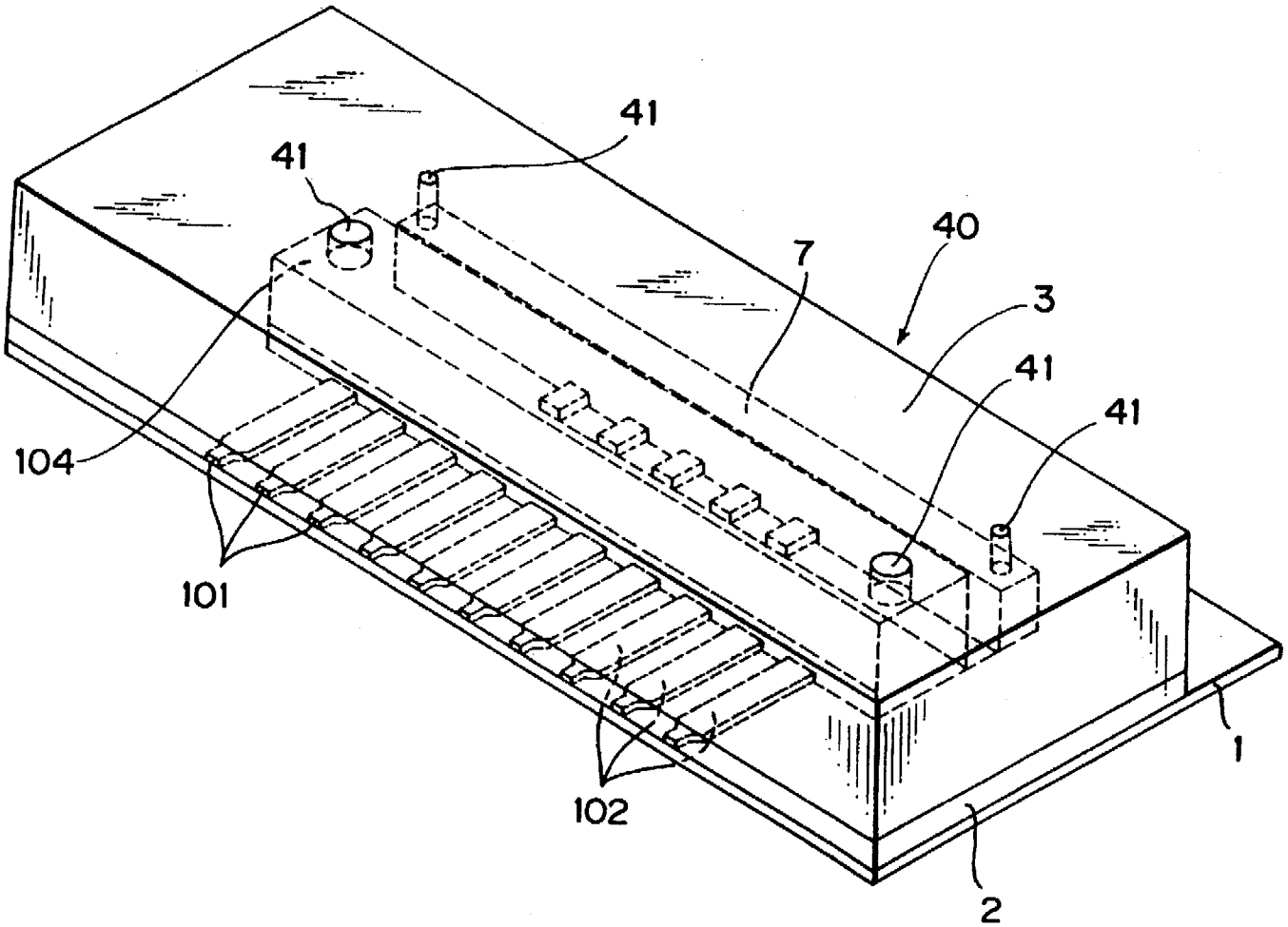
FIG. 25 is a perspective view of the ink jet head, particularly showing by way of example the structure of the ink jet head.
Figure 26:
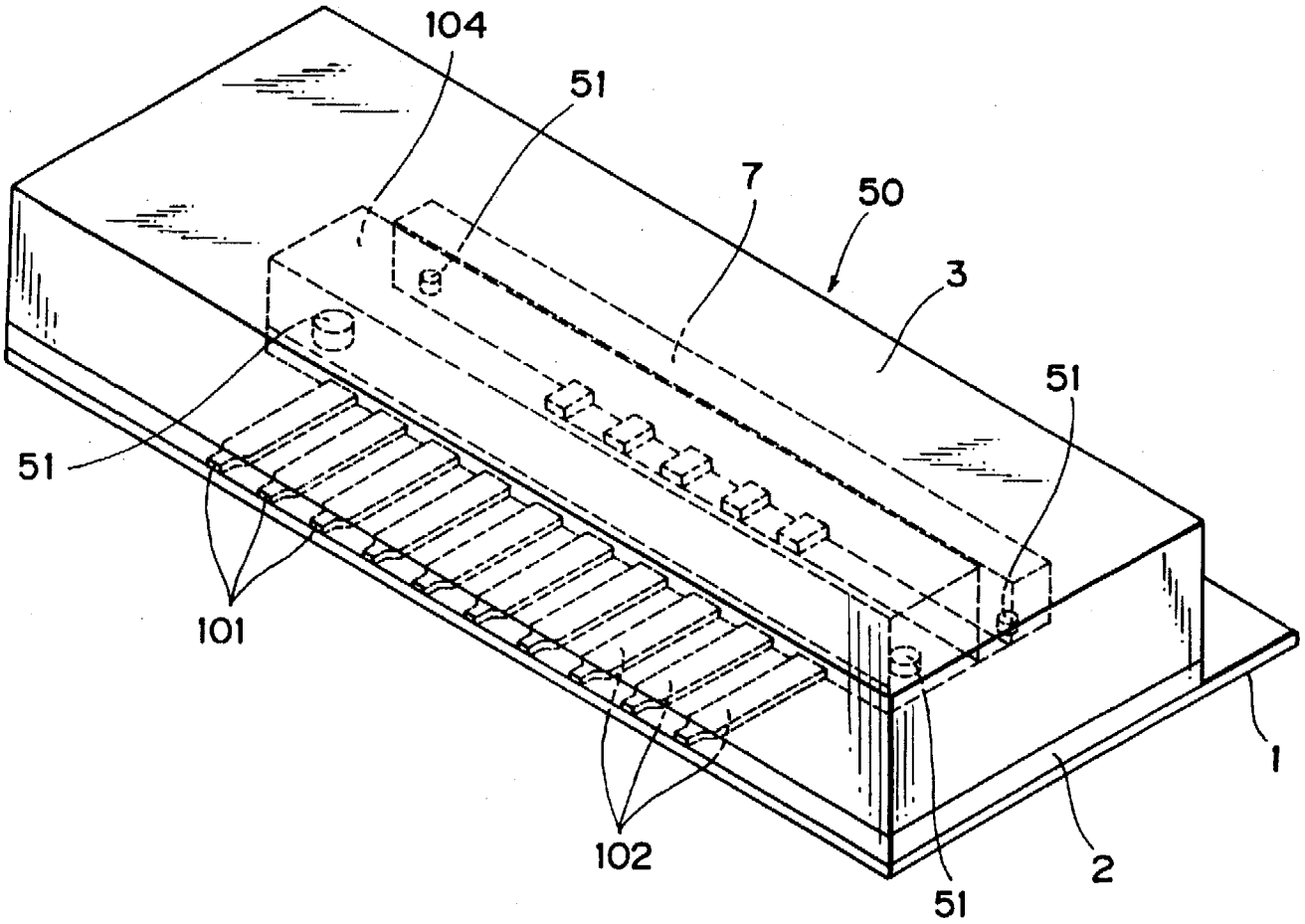
FIG. 26 is a perspective view of the ink jet head, particularly showing by way of another example the structure of the ink jet head.

In addition, FIG. 25 and FIG. 26 show by way of example an ink jet head 40 and an ink jet head 50 each including a second base board 3 of which structure is different from that constructed according to each of the aforementioned embodiments. In the shown embodiment, the opposite ends of a common liquid chamber 104 and an air chamber 7 formed in the second base board 3 are not exposed to the outside in contrast with the aforementioned embodiments. Therefore, in this embodiment, there does not arise a necessity that opening portions on the opposite sides of the air chamber 7 are closed, and moreover, ink feed joints 9A and 9B are connected to opening portions on the opposite ends of the common liquid chamber 104. In FIG. 25, reference numeral 41 designates a hole. This hole 41 is formed in the vicinity of the opposite ends of the common liquid chamber 104 and the air chamber 7 at the upper portions of the both chamber so as to allow a solvent and a dissolved part of the solid layer and the mold member 20 to be discharged to the outside through the hole 41. In FIG. 26, reference numeral 51 designates a hole which is formed on the first base board 1 side for the same purpose as that of the hole 41. According to this embodiment, the ink jet heads 40 and 50 can be produced using the holes 41 and 51 by employing the aforementioned production method.

Figure 27:
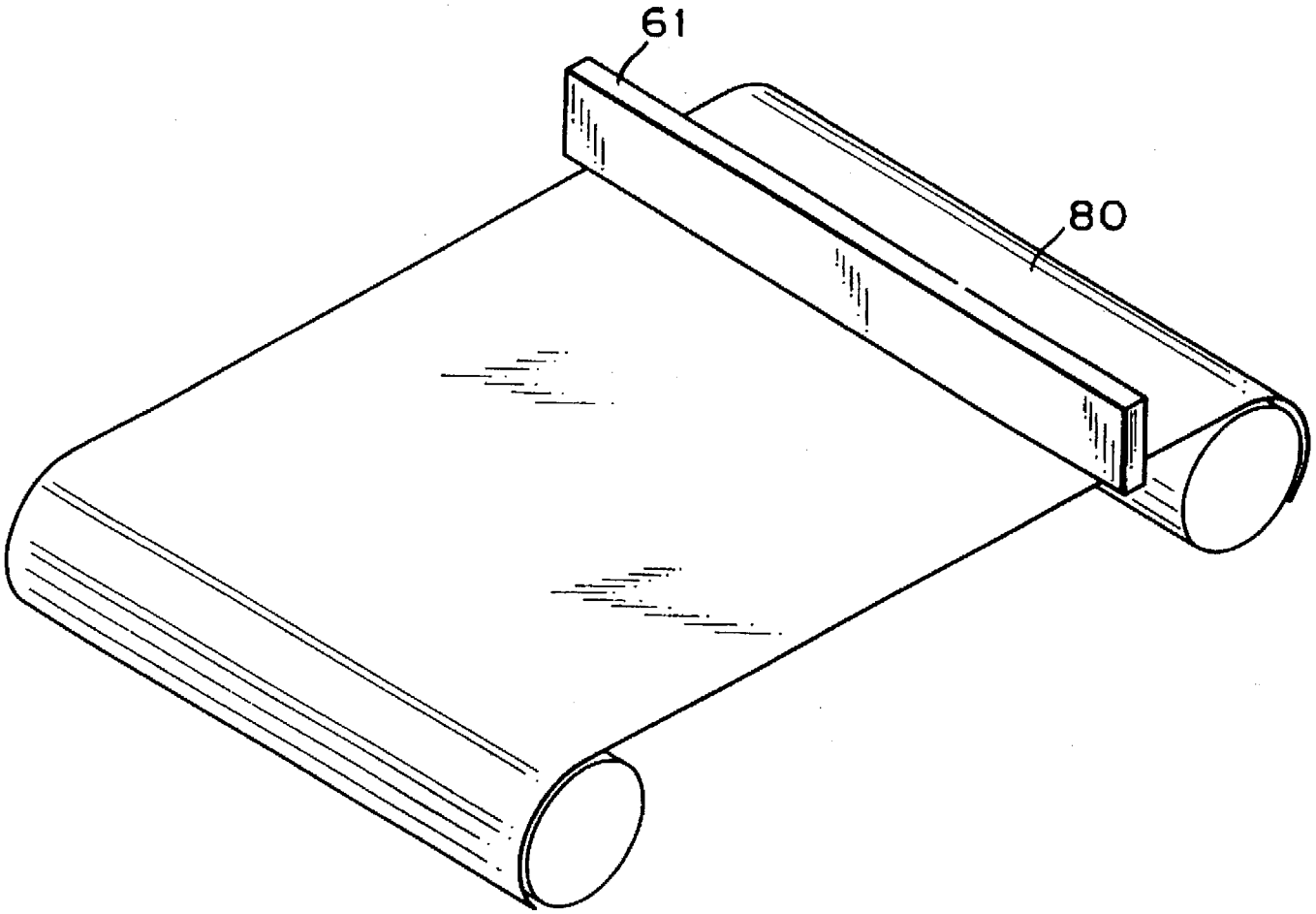
FIG. 27 is a schematic perspective view of an ink jet apparatus constructed according to the present invention, particularly showing by way of example the structure of the ink jet apparatus.

FIG. 27 shows by way of schematic perspective view a so-called full line type recording head having a width corresponding to the recording width of a recording medium such as a paper or the like and a recording apparatus having a recording head of the foregoing type mounted thereon wherein among a plurality of recording heads to each of which the present invention is applicable, most remarkable advantages can be expected with the foregoing recording head.

In FIG. 27, reference numeral 61 designates a full line recording head. With the recording apparatus, ink is ejected from the recording head 61 toward a recording medium 80 such as a paper or the like so as to perform a recording operation. Since there does not arise a malfunction that a quality of recording is degraded with a long recording head like the full line recording head, an article having a high quality of image recorded thereon can be obtained with the recording head of the present invention.

Figure 28:
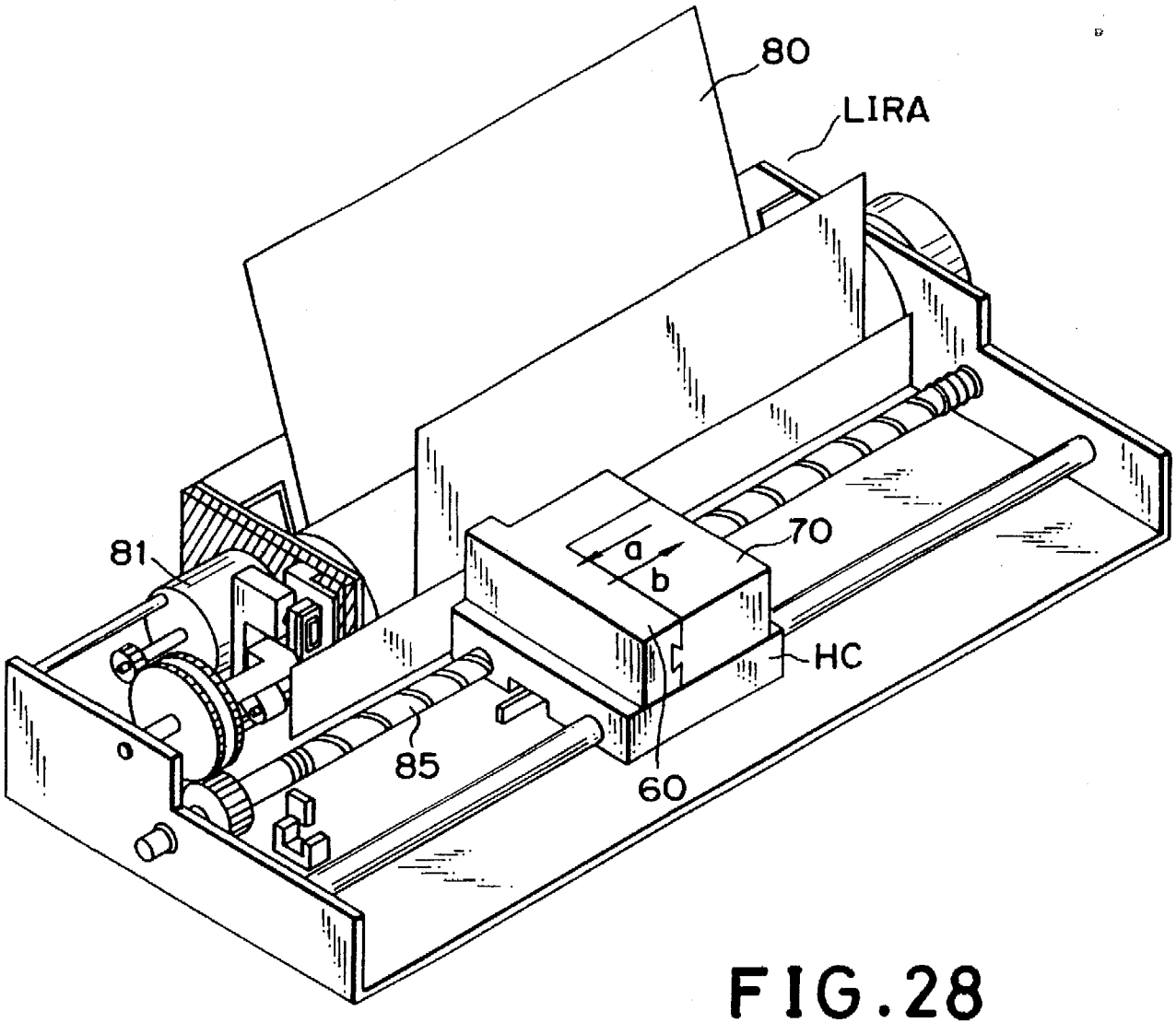
FIG. 28 is a perspective view of the ink jet apparatus, particularly showing by way of another example the structure of the ink jet apparatus.
Figure 29A:
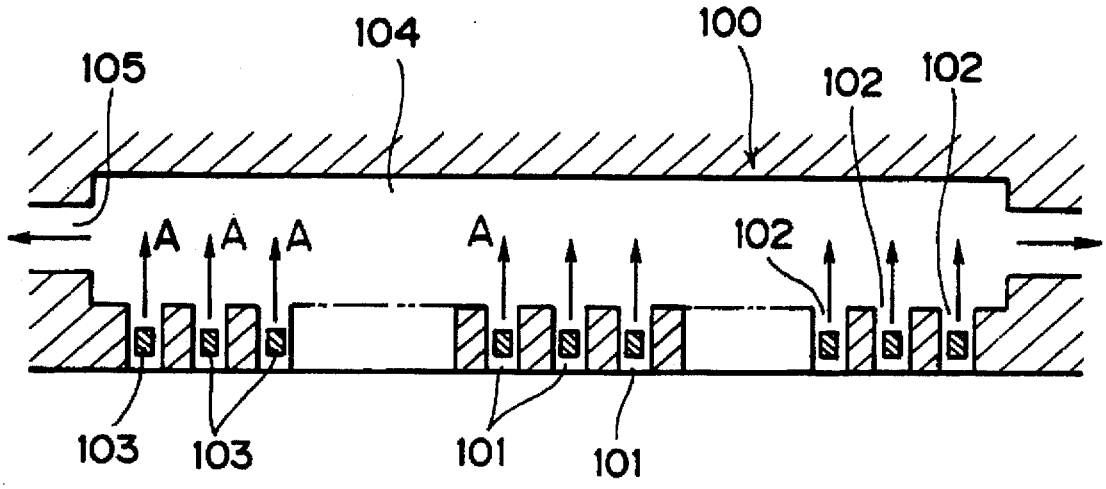
FIG.29A PRIOR ART
FIGS. 29A and 29B are fragmentary sectional plan views of a conventional ink jet head, particularly showing a behavior of ink at the time of ink ejection.
Figure 29B:
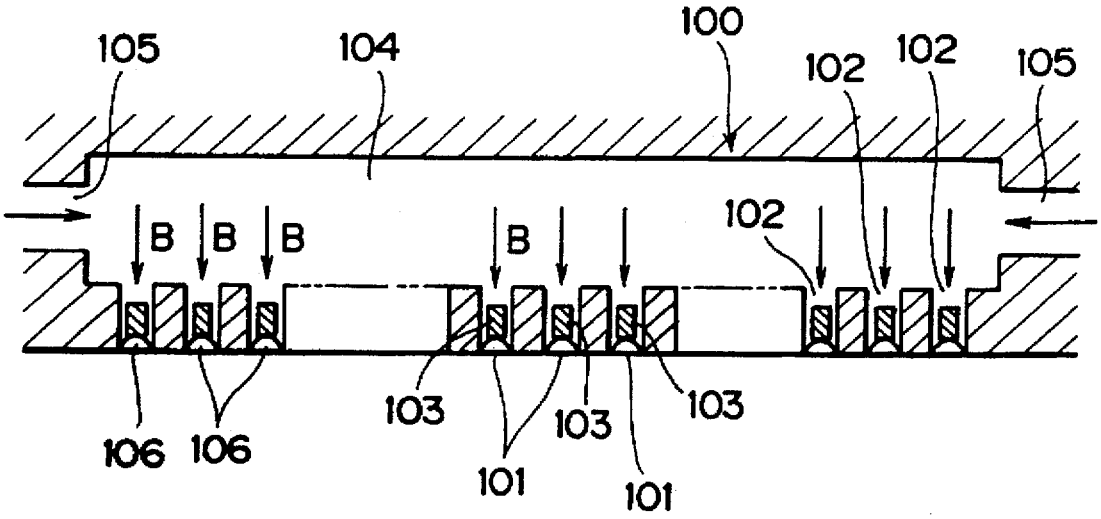
FIG.29B PRIOR ART
Figure 30A:
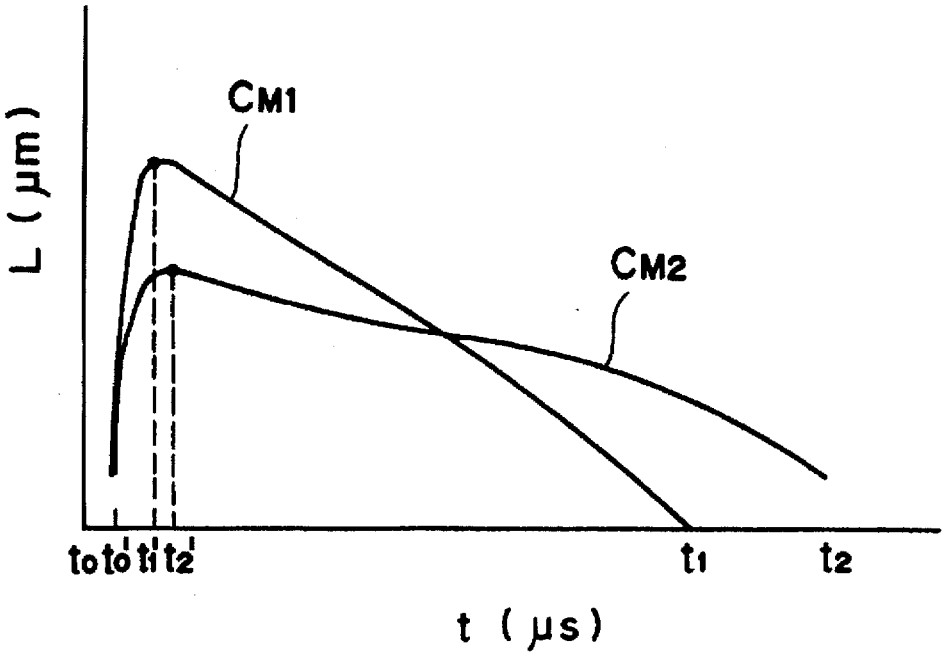
FIG. 30A is a diagram which shows characteristic curves at the time of ink refilling.
Figure 30B:
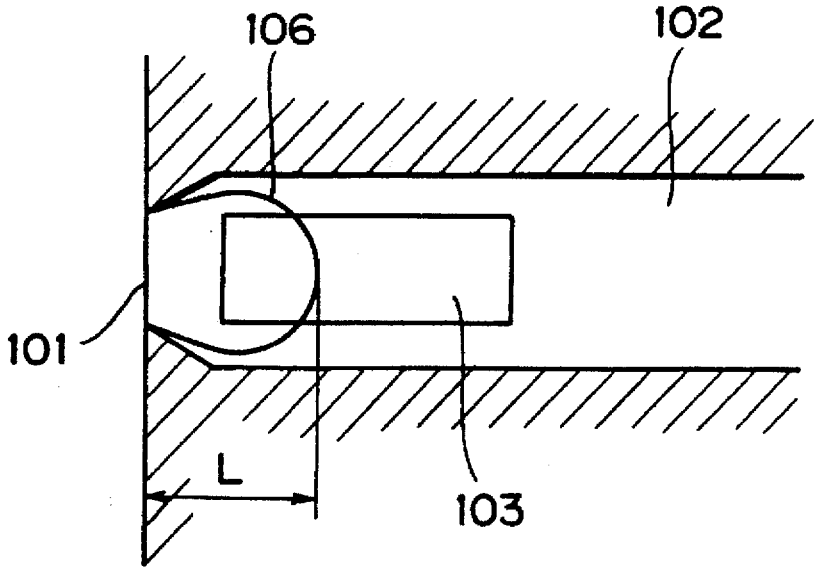
FIG.30B PRIOR ART
FIG. 30B is an enlarged fragmentary sectional plan view of the conventional ink jet head, particularly showing the structure of an ink refilling mechanism.
Figure 31A:
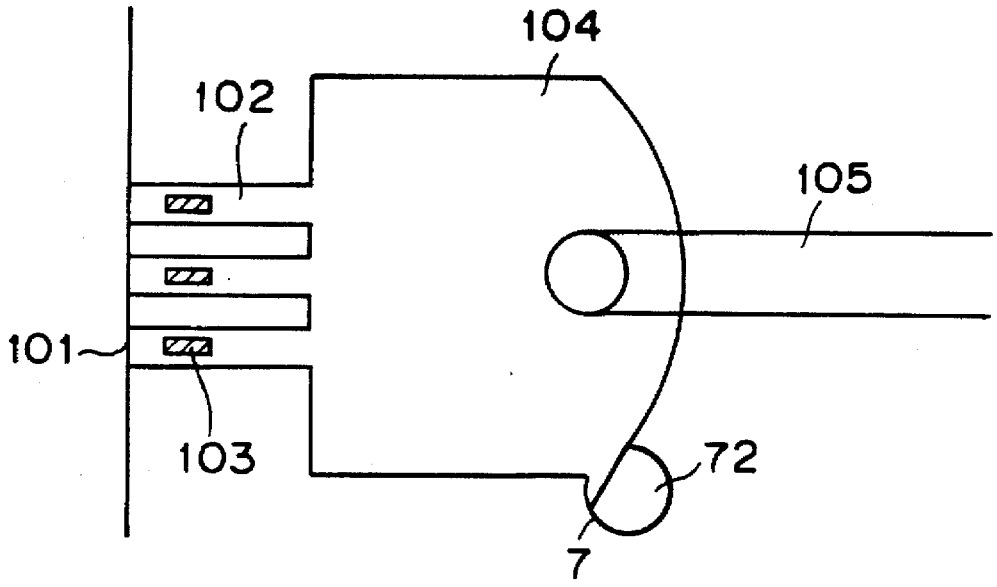
FIG.31A PRIOR ART
FIGS. 31A and 31B are schematic fragmentary sectional plan views of the conventional ink jet head, particularly showing a behavior of gas bubbles, respectively.
Figure 31B:
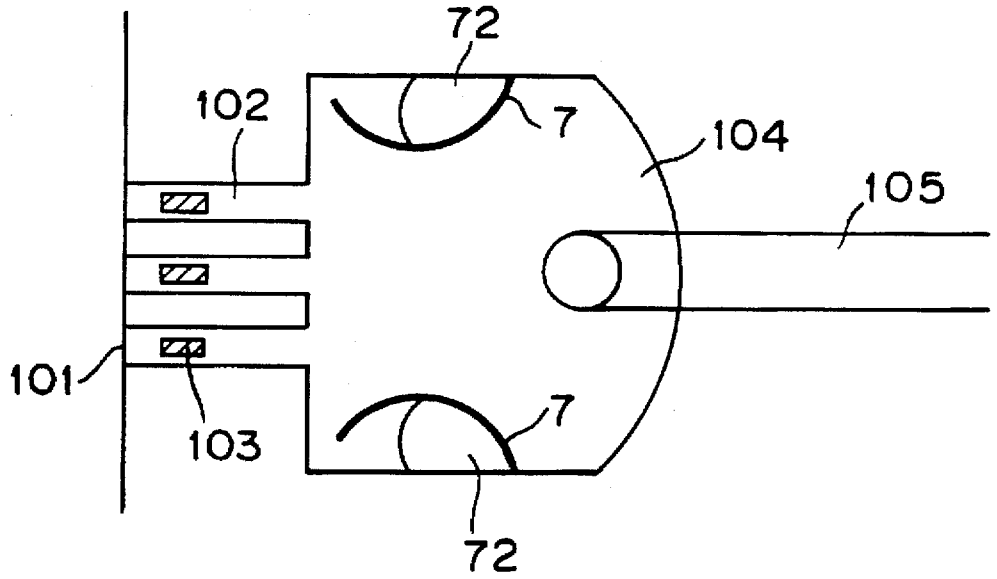
FIG.31B PRIOR ART

FIG. 28 shows by way of perspective view the structure of a recording apparatus having a small recording head mounted thereon. The recording apparatus includes a carriage HC on which an ink tank portion 70 and a recording head portion 60 are removably mounted. In addition, the recording apparatus includes a motor 81 serving as a power source for driving the carriage HC and rollers for conveying the recording medium 80, and a carriage shaft 85 for transmitting the power from the power source to the carriage HC. The apparatus further includes a signal supply means (not shown) for supplying a signal to the ink jet head, whereby ink is ejected from the ink jet head.

As is apparent from the above description, the ink jet head of the present invention is employable for a recording apparatus as mentioned above. In addition, it is preferably employable not only for an ink jet apparatus including a signal receiving section for receiving an image signal from an unit located outside of the recording apparatus and the ink jet head of the present invention but also for an ink jet apparatus including a treatment mechanism for carrying out pretreatment and post-treatment for the purpose of ink fixing on a cloth and threads in addition to the foregoing ink jet head.

As described above, the ink jet head of the present invention includes an air chamber extending in parallel with the direction of arrangement of a plurality of energy generating elements. With this construction, the air chamber has a large volume enough to contain a large quantity of air therein for absorbing ink vibration and pressure fluctuation in the air. Consequently, the present invention can provide a so-called multi-nozzle type ink jet head and an ink jet apparatus which assure that good and quick refill can always be achieved by effectively utilizing the advantages obtainable from the air chamber and that excellent high-speed responsiveness and excellent ink ejection properties can be obtained without any appearance of the problems associated with ink refilling for a number of ink ejecting outlets.

According to the present invention, one of two grooves formed in a second base board is used as an ink feeding chamber and other one of the two grooves is used as an air chamber communicated with the ink feeding chamber via communication paths while a part of the air chamber located adjacent to the communication paths is used as an ink reservoir. With this construction, when recording is achieved by quickly ejecting ink from all the ink ejecting outlets, the ink reservoir serves to supplement ink therefrom. Consequently, the present invention can contribute to actual realization of an ink jet apparatus which assures a high quantity of recording.

Since the communication portion is constructed according to each of the aforementioned embodiments, ink vibration and pressure wave propagating in the ink can effectively be absorbed. Also in the case that recording is effected at a high speed, a high quality of recording can be assured.

With the method of producing an ink jet head according to the present invention, communication paths and ink paths can be formed at a same step, whereby an ink jet head constructed to exhibit the aforementioned advantages can be produced by way of simple steps at an inexpensive cost on the basis of mass production basis.

While the present invention has been described above with respect to preferred embodiments thereof, it should of course be understood that the present invention should not be limited only to these embodiments but various change or modification may be made without any departure from the scope of the present invention as defined by the appended claims.

What is claimed is:

1. An ink jet head including a plurality of ink liquid paths arranged in a side-by-side relationship in a direction of arrangement, each of said plurality of ink liquid paths including an energy generating element for generating energy to eject an ink, and a common liquid chamber having a pair of ends and ink supply ports provided at both of the ends, and which is arranged substantially parallel to the direction of arrangement of said plurality of ink liquid paths for feeding ink to said plurality of ink liquid paths, so as to eject the ink from a plurality of ink ejection outlets in fluid communication with said ink liquid paths by driving the energy generating elements, said ink jet head comprising;

an air chamber extending along an arrangement of said plurality of ink liquid paths and communicated with said common liquid chamber by a communication section located at a substantially central part of said common liquid chamber, said air chamber containing a gas therein for absorbing a pressure fluctuation propagating in the ink received in said common liquid chamber, and a part of said air chamber that is located adjacent to said communication section being used as an ink reserving portion.

2. An ink jet head as claimed in claim 1, wherein said air chamber is divided into plural segments.

3. An ink jet head as claimed in claims 1 or 2, wherein said communication section includes a plurality of communication path walls.

4. An ink jet head as claimed in claims 1 or 2, wherein a volume of said common liquid chamber is larger than a volume of said air chamber.

5. An ink jet head as claimed in claims 1 or 2, wherein said communication section comprises a plurality of communication paths, each having a cross-sectional area, and a cross-sectional area of each of said ink liquid paths is equal to or larger than the cross-sectional area of each of said plurality of communication paths.

6. An ink jet head as claimed in claim 2, wherein said communication section comprises a plurality of communication paths, each having a cross-sectional area, and a total of the cross-sectional areas of said communication paths defining said communication section is greater than a value obtained by converting a total quantity of ink simultaneously ejected from all of said plurality of ink ejection outlets into an area.

7. An ink jet head as claimed in claims 1 or 2, wherein said communication section comprises a plurality of communication paths, each having a cross-sectional area, and a total of the cross-sectional areas of said communication paths defining said communication section is equal to at least 1/10 of said total cross-sectional area of said ink liquid paths.

8. An ink jet head as claimed in claims 1 or 2, wherein said ink ejection outlets are arranged in the form of a full-line head having a width corresponding to a width of a recording medium.

9. An ink jet head as claimed in claims 1 or 2, wherein each of said energy generating elements is a heat generating resistor element.

10. An ink jet apparatus for performing a recording operation by ejecting ink, comprising:

an ink jet head as claimed in claims 1 or 2, and conveying means for conveying a recording medium past said ink jet head so that said ink jet head can record on said recording medium.

11. An ink jet head including a plurality of ink liquid paths arranged in a side-by-side relationship in a direction of arrangement, each of said ink liquid paths having a height, each of said plurality of ink liquid paths including an energy generating element for generating energy to eject an ink, and a common liquid chamber having a pair of ends and ink supply ports provided at both of the ends, and which is arranged substantially parallel to the direction of arrangement of said plurality of ink liquid paths for feeding ink to said plurality of ink liquid paths, so as to eject the ink from a plurality of ink ejection outlets in fluid communication with said ink liquid paths by driving the energy generating elements, said ink jet head comprising;

an air chamber extending along an arrangement of said plurality of ink liquid paths and communicated with said common liquid chamber by a communication section located at a substantially bottom part of said common liquid chamber, said air chamber having a height which is greater than the heights of the ink liquid paths, said air chamber containing a gas therein for absorbing a pressure fluctuation propagating in the ink received in said common liquid chamber, and a part of said air chamber that is located adjacent to said communication section being used as an ink reserving portion.

* * * * *

UNITED STATES PATENT AND TRADEMARK OFFICE

CERTIFICATE OF CORRECTION

PATENT NO. : 5,682,190

DATED : October 28, 1997

INVENTOR(S) : TOSHIAKI HIROSAWA ET AL.

It is certified that error appears in the above-identified patent and that said Letters Patent is hereby corrected as shown below:

[57] ABSTRACT

Line 8, "ls" should read --is--.

COLUMN 2

Line 13, "can not" should read --cannot--.

COLUMN 3

Line 6, "can not" should read --cannot--.

COLUMN 4

Line 46, "can not" should read --cannot--.

COLUMN 6

Line 57, "of;" should read --of:--.

COLUMN 11

Line 3, "can" should read --can be--.

COLUMN 12

Line 48, "be" should be deleted.

UNITED STATES PATENT AND TRADEMARK OFFICE

CERTIFICATE OF CORRECTION

PATENT NO. : 5,682,190

DATED : October 28, 1997

INVENTOR(S) : TOSHIAKI HIROSAWA ET AL.

It is certified that error appears in the above-identified patent and that said Letters Patent is hereby corrected as shown below:

COLUMN 16

Table 2, "4.8 X $10^6$" should read --4.8 X $10^5$--.

COLUMN 17

Line 21, "in" should be deleted.
Line 44, "the" (first occurrence) should be deleted.

COLUMN 18

Line 34, "i" should be deleted.
Line 52, "naphtokinon diadid" should read --naphtokinon-diadid--.

COLUMN 19

Line 2, "number" should read --a number--.
Line 16, "oligomars" should read --oligomers--.
Line 55, "groove" should read --grooves--.

COLUMN 20

Line 39, "few" should be deleted.

COLUMN 22

Line 43, "ray" should read --rays--.

UNITED STATES PATENT AND TRADEMARK OFFICE

CERTIFICATE OF CORRECTION

PATENT NO. : 5,682,190

DATED : October 28, 1997

INVENTOR(S) : TOSHIAKI HIROSAWA ET AL.

It is certified that error appears in the above-identified patent and that said Letters Patent is hereby corrected as shown below:

COLUMN 24

Line 3, "limited" should read --limited to--.
Line 5, "i" should be deleted.

COLUMN 25

Line 15, "an" should read --a--.
Line 57, "production basis." should read --production.--.

COLUMN 26

Line 9, "comprising;" should read --comprising:--.

COLUMN 27

Line 7, "comprising;" should read --comprising:--.

Signed and Sealed this

Eleventh Day of August 1998

Bruce Lehman

*Attest:*

BRUCE LEHMAN

*Attesting Officer*

*Commissioner of Patents and Trademarks*